US010668992B2

(12) United States Patent
Mellina

(10) Patent No.: US 10,668,992 B2
(45) **Date of Patent: *Jun. 2, 2020**

(54) MULTI-POSITION USER SUPPORT DEVICE FOR A STAND-UP PADDLE BOARD

(71) Applicant: Domenico Mellina, Lake Ronkonkoma, NY (US)

(72) Inventor: Domenico Mellina, Lake Ronkonkoma, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/198,496

(22) Filed: Nov. 21, 2018

(65) Prior Publication Data

US 2019/0092434 A1 Mar. 28, 2019

Related U.S. Application Data

(63) Continuation-in-part of application No. 15/982,335, filed on May 17, 2018, now Pat. No. 10,196,113.

(60) Provisional application No. 62/507,909, filed on May 18, 2017.

(51) Int. Cl.
*B63B 32/70* (2020.01)
*B63B 32/00* (2020.01)

(52) U.S. Cl.
CPC ..... *B63B 32/70* (2020.02); *B63B 32/00* (2020.02)

(58) Field of Classification Search
CPC ..... B63B 35/74; B63B 35/85
See application file for complete search history.

(56) References Cited

U.S. PATENT DOCUMENTS

| | | | | |
|---|---|---|---|---|
| 5,901,658 | A * | 5/1999 | Kirkland | B63B 29/06 114/363 |
| 6,062,638 | A * | 5/2000 | Ferguson | A47C 9/025 297/4 |
| 6,632,111 | B2 * | 10/2003 | Oathout | B63H 16/06 440/104 |
| 7,396,083 | B2 * | 7/2008 | Kasner | A01K 97/00 297/188.09 |
| 8,590,478 | B2 * | 11/2013 | Lipman | B63B 34/20 114/363 |
| 9,027,501 | B2 * | 5/2015 | Wood | B63B 29/04 114/363 |
| 9,290,245 | B2 * | 3/2016 | Bishop | B63B 32/70 |
| 9,376,176 | B1 * | 6/2016 | Holden | B63H 16/04 |
| 2011/0088610 | A1 * | 4/2011 | Wood | B63B 29/04 114/363 |
| 2013/0323989 | A1 * | 12/2013 | Derrah | B63H 21/17 440/6 |
| 2014/0187108 | A1 * | 7/2014 | Prade | B63H 16/06 440/104 |

(Continued)

*Primary Examiner* — S. Joseph Morano
*Assistant Examiner* — Jovon E Hayes
(74) *Attorney, Agent, or Firm* — BKDowd Law, P.C.; Betsy Kingsbury Dowd

(57) ABSTRACT

A device for providing user-support on a stand-up paddle board (SUP) includes a support post having a user-support pad mounted to its upper end portion and a horizontal rotation axle around which the support post is rotatable to a position for use, and to a stored position. The device is configured to be mounted to the SUP with the horizontal rotation axle positioned transversely to a length of the SUP. The device includes a spring component returnably connected to the support post via the horizontal rotation axle, configured to impose a return force on the support post in the stored position.

20 Claims, 18 Drawing Sheets

(56) References Cited

U.S. PATENT DOCUMENTS

| | | | | |
|---|---|---|---|---|
| 2017/0043846 | A1* | 2/2017 | Elkinton | A01K 97/10 |
| 2018/0015885 | A1* | 1/2018 | Flaherty | B60R 9/048 |

* cited by examiner

MULTI-POSITION USER SUPPORT DEVICE FOR A STAND-UP PADDLE BOARD

CROSS-REFERENCE TO RELATED APPLICATIONS

This application is a continuation-in-part application of and claims the benefit of and priority to co-pending U.S. Ser. No. 15/982,335, filed on May 17, 2018, entitled "MULTI-POSITION USER SUPPORT DEVICE FOR A STAND-UP PADDLE BOARD," by Domenico Mellina, which in turn claims the benefit of and priority to U.S. Provisional Application Ser. No. 62/507,909 entitled "MULTI-POSITION USER SUPPORT DEVICE AND SYSTEM FOR A STAND-UP PADDLE BOARD," filed May 18, 2017, by Domenico Mellina, the entirety of each of which is hereby incorporated herein by reference thereto.

FIELD OF DISCLOSURE

The present disclosure relates generally to stand-up paddle board accessories, in particular, to seats for stand-up paddle boards.

BACKGROUND

Stand up paddle boards ("SUPs") are a popular alternative to kayaks, canoes and so on to those looking for a full-body workout, while enjoying time on the water. Many SUP enthusiasts also enjoy fishing, leading to a few products that allow some kind of seat positioned on the SUP for that purpose, or simply to allow the user to sit comfortably between stand-up paddling. The incorporation of a seat may also allow a user increased time out on the water during each excursion on a SUP.

To date, two basic types of seats are known for this purpose, each having a post with a seat attached. One type is free-standing, without mechanical attachment to any base on the SUP; and the other requires a permanent base to be installed on the board. The post having the seat attached locks into the base for use. Both the free-standing seat and the seat attachment that locks into the permanent base can be removed from the board when not in use. While the free-standing seat can be folded down out of the way during paddling, it requires some maneuvering to place it back in a seating position again. The lock-in type is extremely difficult to place in a seating position or to remove and lay flat while paddling and must be locked/unlocked from the base to do so.

Both have only two possible positions while on the board, a seating position with the post perpendicular to the board and one with the post horizontal to the board. Both seating types also lack stability. The free-standing type, during use in a seating position, is held onto the board only by the paddler's weight, making it possible to knock the seat over and even off the board, possibly causing injury to the user in the process. On the other hand, while the type that locks appears to be quite sturdy in the upright position, since the post can only lie in a horizontal position when unlatched from the permanent base, it lacks the flexibility to easily move it out of the user's way while out on the water, and thus also creates a safety issue.

Accordingly, there is a need for a multi-position, adjustable, and board-mounted support device for a stand-up paddleboard that is sturdily attached to the SUP while being easy to adjust to a number of positions, including user-selected sitting and leaning (or support) positions and a stowed position, while on the water.

SUMMARY

Features of the disclosure will become apparent from the following detailed description considered in conjunction with the accompanying drawings. It is to be understood, however, that the drawings are designed as an illustration only and not as a definition of the limits of this disclosure.

The present disclosure is directed to a multi-position, adjustable, and board-mounted user-support device for a stand-up paddleboard. The device is sturdily attached to the SUP while being easy to adjust to a number of positions, including user-selected sitting or leaning positions and a stow-away storage position, while on the water.

The present disclosure is also directed to a multi-position user-support device for a stand-up paddle board, which includes a base configured to mount on a stand-up paddle board; a support post rotatably mounted to the base; and a spring component mounted to and between the base and the support post. The support device includes a pad configured to support a user's weight while leaning or sitting thereon, wherein the pad is operatively mounted on an upper end portion of the support post. The spring component is configured to maintain a return force on the support post when the support post is rotated away from the base toward a rear portion of the base and the rear of the stand-up paddle board.

In aspects, the device further includes a telescopic portion adjustable in length.

In additional aspects, the support post is rotatable around the base from a substantially horizontal position, a stored position, over the rear portion of the base and the rear of the stand-up paddle board to a substantially horizontal position, a forward sitting position, forward of the base.

In still additional aspects, the device may further include a seat attachment.

In aspects, the device is configured to enable a user to adjust the support post to a number of angular positions relative to the base, including user-selected leaning positions, the forward sitting position, and the storage position. In additional aspects, the device includes dual-position seating attachment and is further configured to adjust the support post and seating attachment to a sitting stool position.

The present disclosure is also directed to a device for providing user-support on a stand-up paddle board which includes a base, a support post, a user-support pad, and a spring component. The base has a mounting surface for mounting on a stand-up paddle board, and includes a forward portion, a rear portion, and a horizontal rotation axle between the forward portion and the rear portion. A lower end portion of the support post is rotatably connected to the base for rotation around the horizontal rotation axle of the base. The user-support pad is mounted to an upper end portion of the support post. A first end portion of the spring component is fixed to the base and a second end portion of the spring component is returnably connected to the support post via the horizontal rotation axle, the spring component at least partially encircling the horizontal rotation axle. The second end portion is positioned to impose a return force on the support post in a rearwardly rotated position over the rear portion of the base.

In aspects, the spring component further defines a resting position corresponding to a forwardly rotated position around the horizontal rotation axle of the base to which the support post rotatably returns. The support post forms an angle of ninety degrees or less with the forward portion of the base in the resting position.

In various aspects, the spring component includes an elasticized band, a coiled spring or a combination of both.

In other aspects, the spring component includes an elasticized band, with the first end portion of the elasticized band fixed to a first position on the rear portion of the base and the second end portion of the elasticized band fixed to a second position on a forward side of the support post. The forward side of the support post is adjacent to the forward portion of the base. The elasticized band has a relaxed state in the resting position, and is configured to stretch in length between the first position and the second position with rotation of the support post around the horizontal rotation axle toward the rear portion of the base.

In additional aspects, the spring component includes a coiled spring, wherein the first end portion of the coiled spring is fixed to a first position on a forward portion of the base, the second end portion of the coiled spring is fixed to a second position on a rear side of the support post, and a coiled portion between the first end portion and the second end portion is wrapped around the horizontal rotation axle. The coiled spring is in a relaxed state in the resting position, and is configured to twistingly tighten between the first position and the second position with rotation of the support post around the horizontal rotation axle toward the rear portion of the base.

In other aspects, the user-support pad is rotatably connected to the upper end portion of the support post for rotation around an upper rotation axis, which is perpendicular to the support post, of the upper end portion.

In still other aspects, the lower end portion of the support post is rotatable around the horizontal rotation axis of the base to define a forward sitting position of the device. The support post is horizontally disposed over the forward portion of the base in the forward sitting position.

The user-support pad, in aspects, is rotatably connected to the upper end portion of the support post for rotation around an upper rotation axis of the upper end portion, the upper rotation axis being perpendicular to the support post, and is configured to be rotatable to define a back support perpendicular to the base in the forward sitting position of the device.

The user-support pad, in additional aspects, is also rotatable to a lean-back position, the support post in a forwardly rotated position defining a leaning position of the device. The support post is adjustable to an acute angle with the forward portion of the base in the leaning position.

In yet additional aspects, the support post is rotatably positionable horizontally over the rear portion of the base to define a stored position. The spring component is configured to maintain the return force on the support post in the stored position. The device further preferably includes a retaining element fixed to the base and positionable for retaining the support post in the stored position.

In aspects, the retaining element includes a latching portion positioned over the support post in the stored position.

The retaining element may include a spring-activated catch and release mechanism.

In further aspects, the device may include a fixed elbow attached to a rear of the lower end portion of the support post and a spring-activated catch and release mechanism. The spring-activated catch and release mechanism includes a spring-activated elbow catch mounted to the base and positioned to frictionally engage the fixed elbow on the support post in the stored position, and a release pedal operatively connected to the spring-activated elbow catch.

In yet other aspects, the device further includes a dual-position seat attachment.

The dual-position seat attachment may include two legs positioned below the user-support pad and a connector. An upper end of each of the two legs is hingedly coupled via the connector to the upper end portion of the support post. The seat attachment may also include a fixing element configured to fix a bottom end of each of the two legs to the support post in a first position, wherein the two legs are fixed via the fixing element in-line with the support post in the first position.

The fixing element is further configured to release the two legs from the first position in-line with the support post to rotate to a second position of the dual-position seat attachment. The dual-position seat attachment further includes a stabilizing base fixed to the bottom end of each of the two legs, the stabilizing base being horizontally disposed adjacent the forward portion of the base in the second position.

In still other aspects, the support post includes a telescopic length-adjusting portion, the support post being fixedly adjustable in length via the telescopic length-adjusting portion.

In aspects, the base is formed of a deformable plastic material and includes an upper surface, the upper surface including one or more strap-receiving recessed channels traversing a width of the base across at least one of the forward portion and the rear portion.

The present disclosure is also directed to a device for providing user-support on a stand-up paddle board. The device includes a support post, the support post including a user-support pad mounted to an upper end portion of the support post; and a horizontal rotation axle, the support post rotatably connected to the horizontal rotation axle for rotation to a position for use, and to a stored position. The device is configured to be mounted to the stand-up paddle board with the horizontal rotation axle positioned transversely to a length of the stand-up paddle board. The device also includes a spring component, which is returnably connected to the support post via the horizontal rotation axle and configured to impose a return force on the support post in the stored position.

In aspects, the device may further include a fixed arm operatively mounted to the stand-up paddle board and a positioning arm operatively connected to the support post, wherein the positioning arm is co-aligned with and rotationally positionable to the fixed arm via the horizontal rotation axis.

In aspects, the spring component at least partially encircles the horizontal rotation axle, the spring component including a first end portion fixed to the fixed arm and a second end portion fixed to the positioning arm such that rotation of the positioning arm toward the stored position twistingly tightens the spring component to impose the return force on the support post.

The positioning arm, in aspects, may include locking grooves and the fixed arm may include complementary locking grooves configured to interlock with the locking grooves, the locking grooves and the complementary locking grooves positioned on interior facing surfaces of the positioning arm and the fixed arm, respectively, for locking the support post to the position, i.e., to a locked rotational position, for use.

The spring component may, in aspects, be sandwiched between the positioning arm and the fixed arm in the locked rotational position for use.

In additional aspects, the device may include a locking element configured to force the positioning arm and the fixed arm together for locking the support post to the locked rotational position, and to separate the positioning arm and the fixed arm for unlocking and rotating the support post.

In further aspects, a fixed tab is attached to a first end portion of the horizontal rotation axle, and is positioned on an outer surface of the positioning arm. The horizontal rotation axle may also include a second end portion extending through an outer surface of the fixed arm, wherein the locking element is connected to the second end portion and includes a locking tab having a downward position. The locking tab in the downward position cooperates with the fixed tab to force the fixed arm and the positioning arm together in the locked rotational position. In an upward position, the locking tab cooperates with the fixed tab to separate and disengage the fixed arm and the positioning arm for rotating the support post.

The locking element, in aspects, is configured to lock the support post in the stored position with the return force on the support post, the spring component being tighteningly twisted in the stored position. The support post springs upward from the stored position with the unlocking of the locking element to separate the positioning arm and the fixed arm.

In some aspects, the device also includes a base configured to removably mount the device to the stand-up paddle board.

In some aspects, the device also includes a dual-position seat attachment.

The present disclosure is also directed to a stand-up paddle board, which includes a device for providing user-support on a stand-up paddle board. In aspects, the device may include a base and be removably mounted to the stand-up paddle board via the base. In additional aspects, the stand-up paddle board may include a recessed surface to which at least a portion of the base is mounted thereto.

The device includes a support post, the support post including a user-support pad mounted to an upper end portion of the support post; and a horizontal rotation axle, the support post rotatably connected to the horizontal rotation axle for rotation to a position for use, and to a stored position. The device is mounted to the stand-up paddle board with the horizontal rotation axle positioned transversely to a length of the stand-up paddle board. The device also includes a spring component, returnably connected to the support post via the horizontal rotation axle and configured to impose a return force on the support post in the stored position.

In aspects, the device further includes a fixed arm operatively mounted to the stand-up paddle board and a positioning arm operatively connected to the support post, wherein the positioning arm is co-aligned with and rotationally positionable to the fixed arm via the horizontal rotation axis.

In additional aspects, the spring component at least partially encircles the horizontal rotation axle, the spring component including a first end portion fixed to the fixed arm and a second end portion fixed to the positioning arm such that rotation of the positioning arm toward the stored position twistingly tightens the spring component to impose the return force on the support post.

The positioning arm includes, in aspects, locking grooves and the fixed arm includes, in aspects, complementary locking grooves configured to interlock with the locking grooves. The locking grooves and the complementary locking grooves are positioned on interior facing surfaces of the positioning arm and the fixed arm, respectively, for locking the support post in the position to a locked rotational position for use, with the spring component sandwiched between the positioning arm and the fixed arm in the locked rotational position.

In aspects, the device further includes a locking element configured to force the positioning arm and the fixed arm together for locking the position to the locked rotational position and to separate the positioning arm and the fixed arm for unlocking and rotating the support post.

In aspects, the device further includes a fixed tab attached to a first end portion of the horizontal rotation axle and positioned on an outer surface of the positioning arm. The horizontal rotation axle also includes, in aspects, a second end portion extending through an outer surface of the fixed arm, wherein the locking element is connected to the second end portion and includes a locking tab. In a downward position, the locking tab cooperates with the fixed tab to force the fixed arm and the positioning arm together in the locked rotational position. The locking tab in an upward position cooperates with the fixed tab to separate and disengage the fixed arm and the positioning arm for rotating the support post.

The locking tab, in aspects, is also configured to lock the support post in the stored position with the return force on the support post, the spring component being tighteningly twisted in the stored position. The support post is configured to spring upward from the stored position with the unlocking of the locking element to separate the positioning arm and the fixed arm.

In aspects, the device may further include a dual-position seat attachment, wherein the dual-position seat attachment includes two legs positioned below the user-support pad and a connector, an upper end of each of the two legs hingedly coupled via the connector to an upper end portion of the support post, and a fixing element configured to fix a bottom end of each of the two legs to the support post in a first position. The two legs may be fixed via the fixing element in-line with the support post in the first position. The fixing element may be further configured to release the two legs from the first position to rotate to a second position of the dual-position seat attachment, the dual-position seat attachment further including a stabilizing base fixed to the bottom end of each of the two legs.

In addition to the above aspects of the present disclosure, additional aspects, objects, features and advantages will be apparent from the embodiments presented in the following description and in connection with the accompanying drawings.

BRIEF DESCRIPTION OF THE DRAWINGS

The drawings constitute a part of this disclosure and include examples, which may be implemented in various forms. It is to be understood that in some instances, various aspects of the disclosure may be shown exaggerated or enlarged to facilitate understanding. The teaching of the disclosure can be readily understood by considering the detailed description in conjunction with the accompanying drawings, which are briefly described below.

Figure 1A:
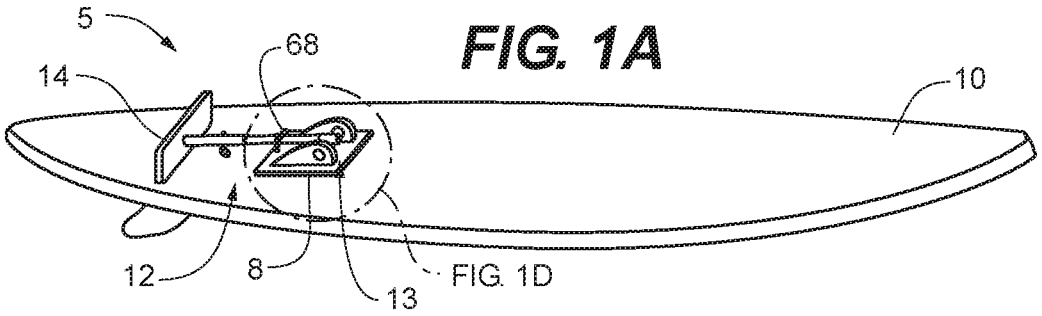
FIGS. 1A-1C are pictorial representations of three different positions, via a support post rotatably-mounted to a base, of embodiments of a user-support device for a stand-up paddleboard ("SUP") of the present disclosure: a stowed position, a lean-back position, and a forward sitting position, respectively.

The various aspects of the present disclosure mentioned above are described in further detail with reference to the aforementioned figures and the following detailed description of exemplary embodiments.

DETAILED DESCRIPTION

Particular illustrative embodiments of the present disclosure are described hereinbelow with reference to the accompanying drawings; however, the disclosed embodiments are merely examples of the disclosure, which may be embodied in various forms. It should be apparent to those skilled in the art that the described embodiments provided herein are illustrative only and not limiting, having been presented by way of example only. All features disclosed in this description may be replaced by alternative features serving the same or similar purpose, unless expressly stated otherwise. Therefore, numerous other embodiments of the modifications thereof are contemplated as falling within the scope of the present disclosure as defined herein and equivalents thereto. Well-known functions or constructions and repetitive matter are not described in detail to avoid obscuring the present disclosure in unnecessary or redundant detail. Therefore, specific structural and functional details disclosed herein are not to be interpreted as limiting. In this description, as well as in the drawings, like-referenced numbers represent elements which may perform the same, similar, or equivalent functions.

Throughout the description, where items are described as having, including, or comprising one or more specific components or features, it is contemplated that, additionally, there are items of the present disclosure that consist essentially of, or consist of, the one or more recited components or features.

As described below in reference to a particular embodiment shown in the figures, the present disclosure is directed to a multi-position adjustable and board-mounted user support device that enables a user to select and easily switch between a plurality of positions while the user and SUP are already on the water. The plurality of positions includes positions for supporting the user while paddling or resting, and a stowed position when not in use with a very small footprint.

Referring to FIGS. 1A-1D, an embodiment of a device 5 of the present disclosure includes a base 8 that is preferably configured to mount to a stand-up paddle board 10 ("SUP") using any suitable fixing means to affix the base 8 on the SUP. In embodiments, the base 8 may be fixed so that it becomes a permanent fixture on the SUP and is not easily removed without damage to the SUP. In some embodiments, a mounting surface 2 of the base 8 may be affixed with mounting hardware such as screws, and/or with any suitable durable, water-proof epoxy, and/or the mounting surface 2 may include a rubberized mounting suction cup.

In other embodiments, the base 8 may be configured to be removably mounted via a brace and/or straps (see, e.g., straps 100, FIG. 7C) or other less permanent means to the SUP.

Figure 1B:
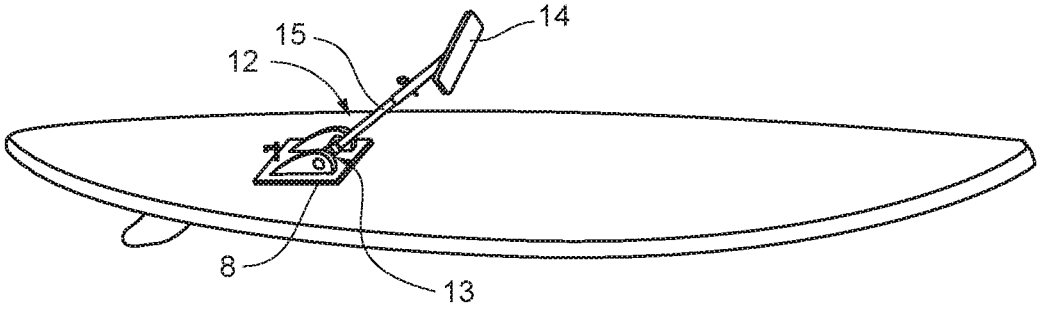
Figure 1C:
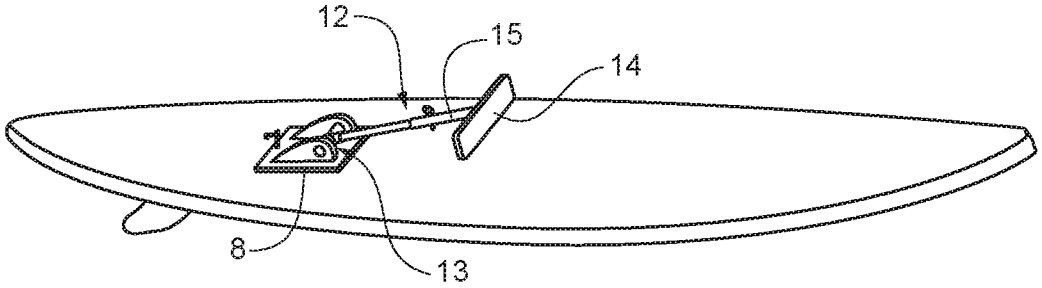
Figure 1D:
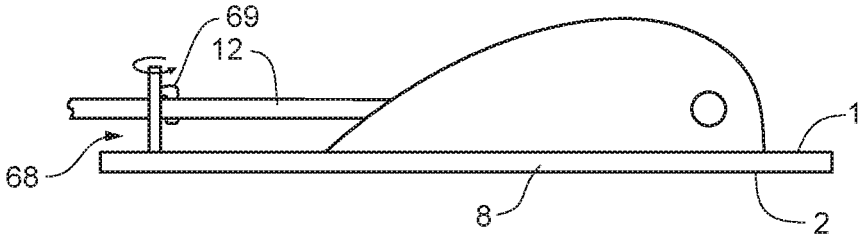
FIG. 1D is a close-up of the base of the device of FIG. 1A in the stowed position.

Referring to FIG. 1D, the base 8 of the user-support device 5, in embodiments, is formed of a pliable, preferably a deformable plastic material, and has an upper surface 1 substantially parallel to the mounting surface 2. Preferably the mounting surface 2 is sufficiently pliable to conform to the shape of, and be mounted flush to, the top surface of the SUP.

Figure 2A:
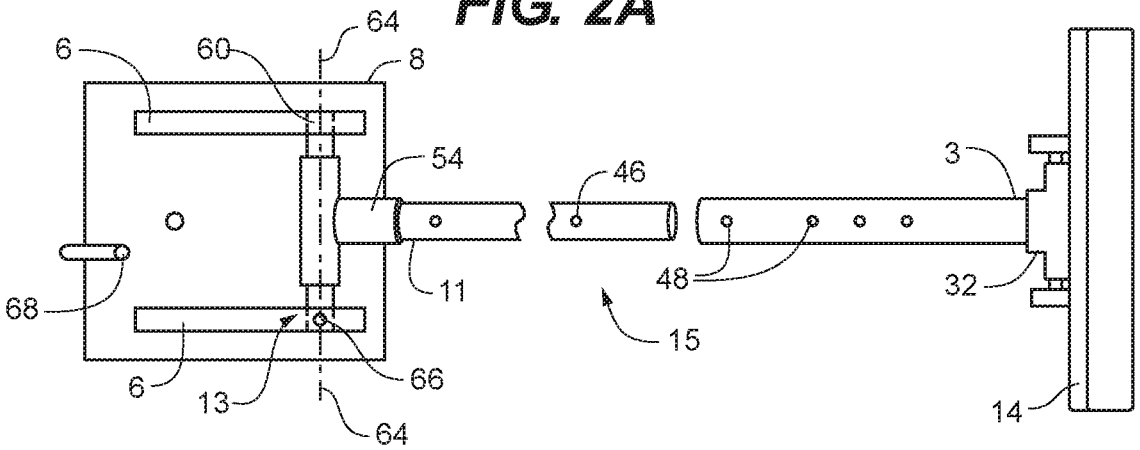
FIG. 2A is a pictorial representation of a partially exploded top view of an embodiment of the user-support device for a SUP rotated to a lean-back position in accordance with the present disclosure.
Figure 2B:
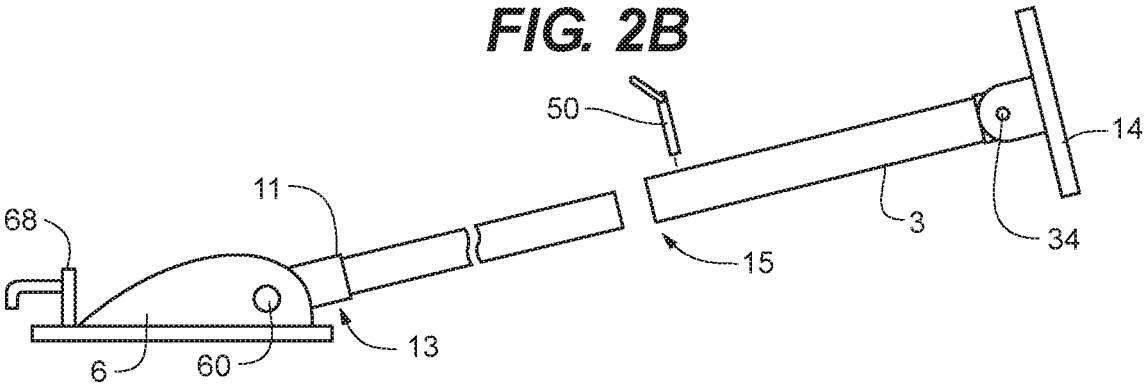
FIG. 2B is a pictorial representation of a partially exploded side view of the device shown in FIG. 2A with the support post rotated to a lean-back position.
Figure 2C:
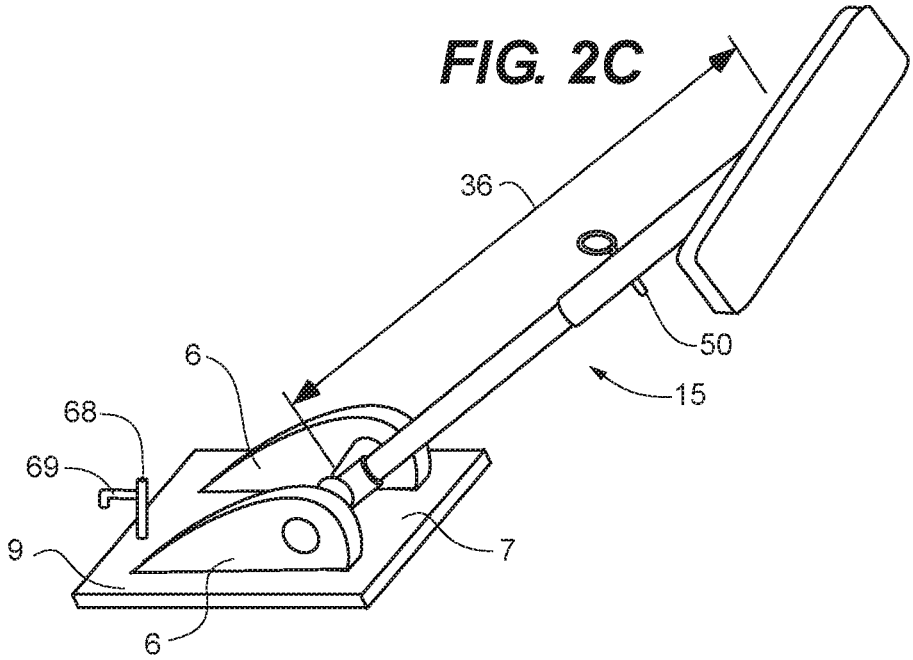
FIG. 2C is a pictorial representation of a perspective side view of the device shown in FIGS. 2A and 2B with the support post rotated to another lean-back position.

Referring to FIGS. 2A-2C, the device 5 further includes a support post 12 including a lower end portion 11 rotatably mounted or connected to the base 8, for example, via a mounting assembly 13, for rotation around a horizontal rotation axis 64 of the base 8. In the embodiments of FIGS. 2A-2C, the horizontal rotation axis 64 is defined by a horizontal rotation axle 60, which may be, e.g., a cylindrical pin fixed to the base 8.

The support post 12, in embodiments, may be configured to be removably mounted at the lower end portion 11 to the base 8. Accordingly, the base 8 may remain attached to the board 10, either by permanent fixing means or by other removable means, when the SUP is not in use, while the remainder of the device 5 is removed to facilitate transporting the SUP and/or device 5 out of the water.

Referring to FIGS. 2A and 2C, for example, the base 8 includes a forward portion 7 and a rear portion 9, with the horizontal rotation axis 64, e.g., horizontal rotation axle 60, traversing the width of the base 8 and positioned between the forward portion 7 and the rear portion 9. In embodiments, the base 8 also includes two support rails 6, for example, raised side support rails 6 projecting upward from the floor of the base 8, to which each end of the horizontal axle 60 is operatively connected.

In some embodiments, the base 8, including support rails 6, may be integral with the SUP, so that the user-support device 5 is removably mounted to the SUP via the rotation axle 60.

Each of the side support rails 6 in embodiments extends from the forward portion 7 to the rear portion 9 of the base 8. It will be appreciated that a SUP is configured for efficient forward travel in one direction and has a streamlined shape for that purpose that includes a nose and a tail corresponding to a forward section and rear section of the SUP, respectively, relative to the direction of travel. The device 5 is configured to mount onto a SUP such that the forward portion 7 of the base 8 is adjacent a forward section of the SUP, relative to the position of the rotation axle 60. Similarly, a forward rotation of the support post 12 refers herein to a rotation of the support post 12 in the forward direction of travel of the SUP, such that a forwardly rotated position of the support post 12 would position the support post 12 over the forward portion 7 of the base 8 and over the forward section of the SUP on which the base 8 is mounted. Likewise, when mounted onto a SUP, the rear portion 9 of the base 8 is adjacent a rear section of the SUP, relative to the position of the rotation axle 60.

Referring still to FIGS. 2A-2C, the device 5 further includes a user-support pad 14 mounted on an upper end portion 3 of the support post 12, against which a user may lean, and/or on which the user may sit in various embodiments. In embodiments, the mounting assembly 13, in cooperation with the base 8, enables rotation of the support post 12 and user-support pad 14 around the horizontal rotation axle 60 to any desired position.

Preferably, the user-support pad 14 is pivotedly or rotatably connected to the upper end portion 3 of the support post 12 to enable different positions and uses of the device 5. A nominal, default position of user-support pad 14 may be perpendicular to the support post 12 for providing a forward sitting position (FIG. 1C), or certain lean-back positions. Preferably, the pad 14 is also configured to rotate forward and aft of nominal. For example, in a stowed position for the device 5 when not in use, also referred to herein as a stored position, as shown in FIG. 1A, the support post 12 is rotated down onto a rear of the board 10 so that the support post 12 is positioned horizontally over the rear portion 9 of the base 8. The pad 14 may also be rotated around an upper horizontal axis 34, which is oriented perpendicular to the support post 12, to be substantially aligned with the support post 12, i.e., substantially horizontal to the board 10, in the stored position.

Referring to FIG. 1C, the support post 12, via the lower end portion 11, is also rotatable around the horizontal rotation axis 64 of the base 8 to define a forward sitting position of the device 5, such that the support post 12 is horizontally disposed over the forward portion 7 of the base 8. In the forward sitting position, the user-support pad 14 is rotatable around the upper horizontal axis 34 to define a back support perpendicular to the base 8, as shown in FIG. 1C. In this position, a paddler may sit on the board 10 and lean back on the user-support pad 14, using the pad 14 as a back rest. In FIG. 1C, the support post 12 may be forwardly rotated until one side of the pad 14 rests on the SUP 10.

Referring, for example, to FIGS. 1B and 2B, the support post 12 is also rotatable and able to be used at any acute angle with the forward portion 7 of the base 8 that a user is comfortable with, in a lean-back position. The user-support pad 14 is rotatable around the upper horizontal axis 34 to a vertical or substantially vertical position with the support post 12 in a forwardly rotated position, or to any other rotated position that is comfortable for a paddler to lean back against.

Referring still to FIGS. 2A-2C, in embodiments, the device 5 may further include a telescoping portion 15, which allows a length 36 of the support post 12 to be adjusted and fixed to the adjusted length as desired by the paddler. For example, in the stowed position, FIG. 1A, and the completely forward sitting position, FIG. 1C, the paddler may choose to shorten the support post 12 as much as possible. For leaning positions, as represented in FIG. 1B, the telescoping portion 15 may be adjusted by the user to an optimum length customized to the user's height, and the angular leaning position chosen by the user.

In embodiments, the support post 12 and base 8 are configured to freely swing in a controlled manner from the stowed position of FIG. 1A to the completely forward position of FIG. 1C and any position in between. In choosing a suitable angular leaning position as represented by FIG. 1B, for example, the paddler adjusts the length 36 of the support post 12 by adjusting the telescoping portion 15 and distributes his/her weight as needed to obtain a stable tripod effect, offering relief from standing while still being able to paddle. In this way, the device 5 may be stabilized to a particular position without the need for any additional hardware to lock in a user's chosen angular position.

In other embodiments, the device 5 may also include any suitable means known in the art, such as stabilizing ties of appropriate length attaching a forward-leaning support post 12 to the rear portion and/or to the forward portion of the base 8 or to the board 10 itself, to further stabilize the user's chosen angular leaning position.

Figure 3A:
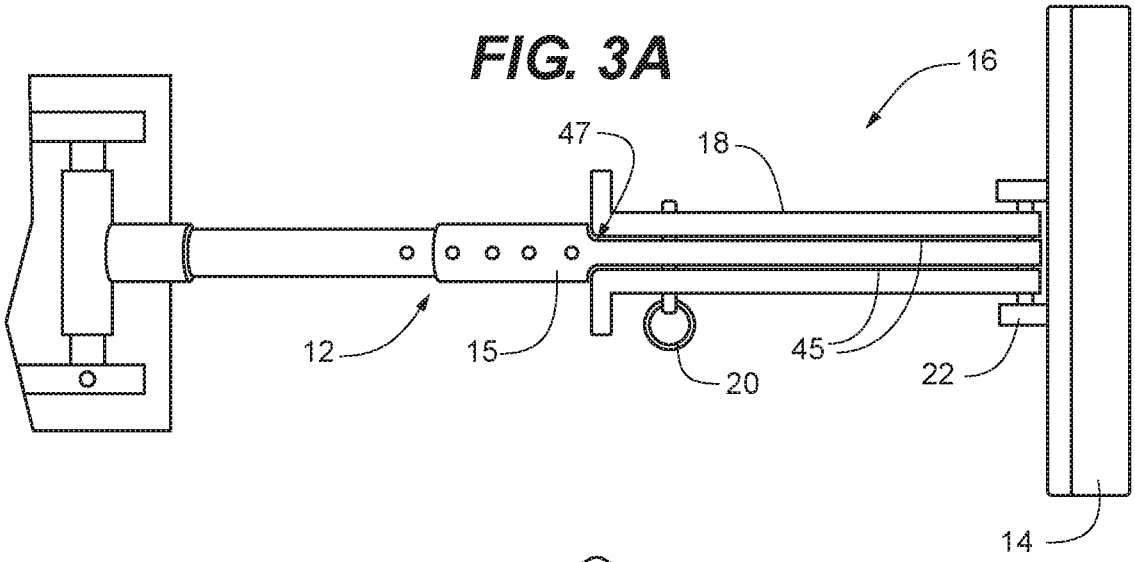
FIG. 3A is a pictorial representation of a top view of another embodiment of a user-support device for a SUP of the present disclosure, which includes a dual-position seat attachment shown in a first position, in fixed alignment with the support post (support post is shown in a lean-back position).
Figure 3B:
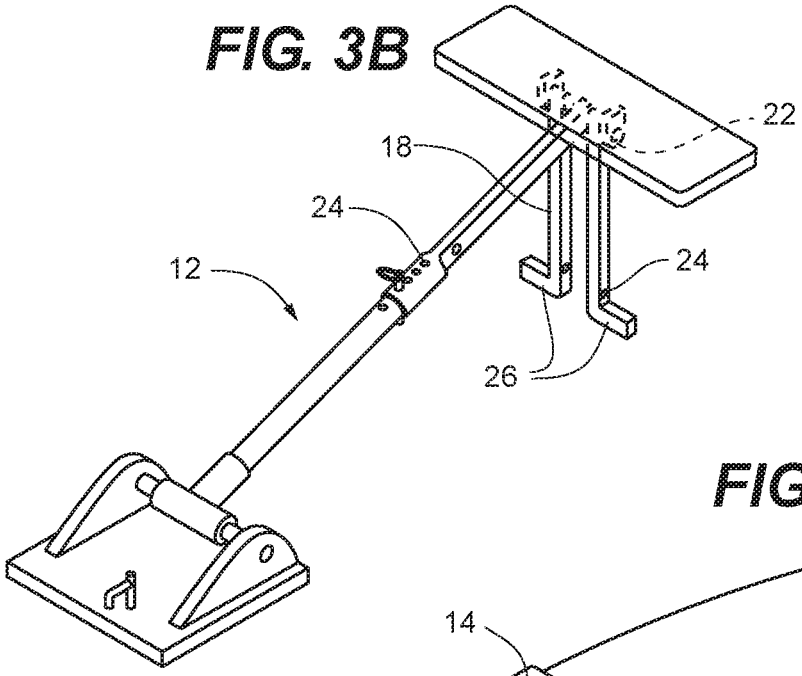
FIG. 3B is a pictorial representation of a perspective side view of the device of FIG. 3A, with the dual-position seat attachment detached from the support post and rotated to a second position, for use as a stool.
Figure 3C:
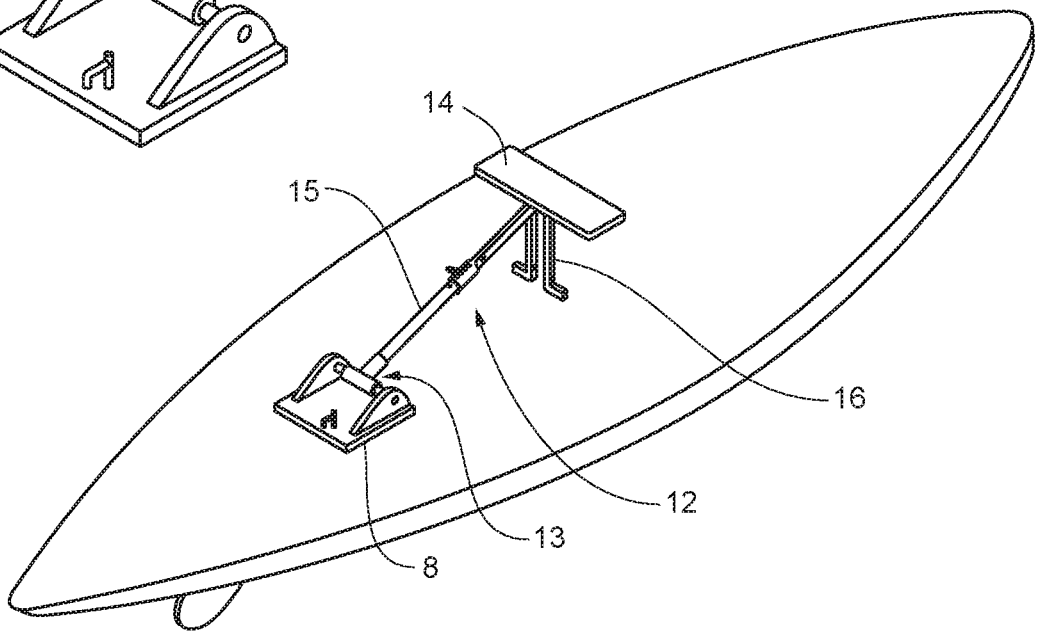
FIG. 3C is a pictorial representation of the device of FIG. 3B mounted on a SUP.
Figure 3D:
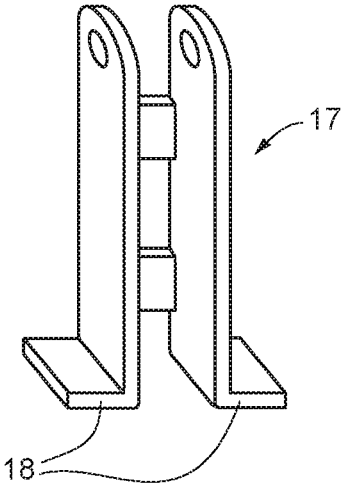
FIG. 3D is a pictorial representation of a perspective rear view of an embodiment of the dual-position seat support attachment, before assembly with a pad and telescoping portion of an embodiment of a user-support device.
Figure 3E:
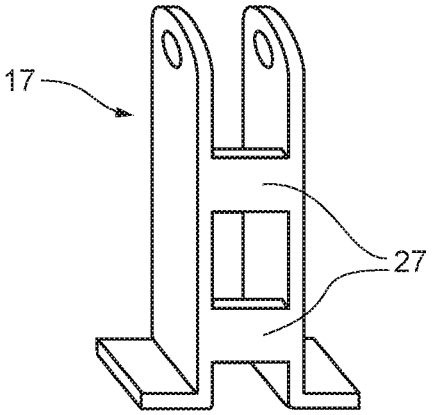
FIG. 3E is a pictorial representation of a perspective front view of the dual-position seat support attachment of FIG. 3D.
Figure 3F:
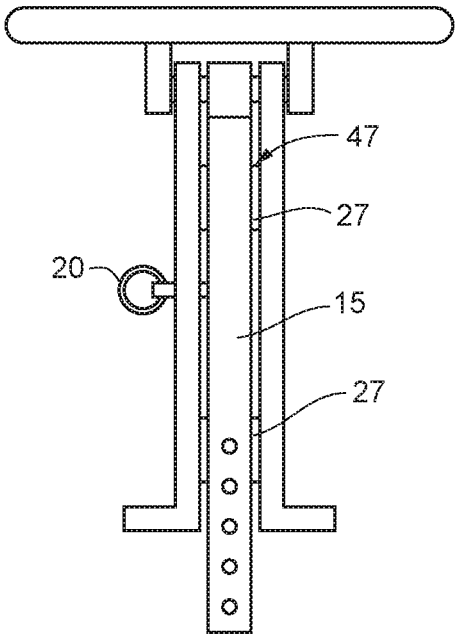
FIG. 3F is a pictorial representation of a dual-position seat attachment portion of another embodiment of a user-support device for a SUP of the present disclosure, shown fixed in-line with the support post.

Referring to FIGS. 3A-3F, in embodiments, the device 5 may also include a seat attachment 16, which is preferably a dual-position seat attachment, like that shown in FIGS. 3A-3C or like seat attachment 17 shown in FIGS. 3D-3F as another example. The dual-position seat attachment of the disclosure, in embodiments, preferably includes a pair of supporting legs 18 positioned below the user-support pad 14, wherein each upper end of the supporting legs 18 is hingedly coupled, via a connector 22, for example, to the upper end portion 3 of the support post 12. Preferably, the seat-attachment also includes a fixing element configured to fix the supporting legs 18 to, and in-line with, the support post 12 in a first position. Any suitable fixing element may be used to hold the seat attachment in alignment with the support post 12. In embodiments, the fixing element includes apertures 24 located on the supporting legs 18. A removable retaining pin 20 inserted through mutually-aligned through apertures 24 in both the support post 12 and supporting legs 18 fixes the device 5 in the first, in-line position.

When the device 5 is either in the stowed position of FIG. 1A, or any of the lean back or forward sitting positions, as shown, e.g., in FIGS. 1B and 1C, the seat attachment 16, 17, is preferably fixed in a first position, with supporting legs 18 fixed in-line with the longitudinal axis of the support post 12, which may include telescoping portion 15 in embodiments. Referring to FIGS. 3A-3C, to use the seating attachment in its second position as a stool for sitting on the SUP, the user can simply pull the retaining pin 20 out to hingedly release bottom ends 26 of the legs 18 from their in-line position, allowing the free ends 26 of the legs 18 to hingedly swing away from the base 8 and rest flat against the SUP 10.

In embodiments, the retaining pin 20 is preferably tethered via string, rope, wire, twine or other suitable materials, to an attachment point (not shown) on the device 5, so that it can be easily retrieved by the user for reinsertion through the apertures 24, when desired.

Referring to FIGS. 3D-3F, embodiments of the seat attachment 17 of the disclosure may also include stability components 27 for enhancing the weight-bearing capacity of the seat attachment. As shown, these components 27 may include horizontal bars connecting the legs, preferably positioned on a forward side (corresponding to forward position of the base 8) of the legs 18, so that the stability components 27 do not prevent the legs 18 from being positioned in alignment with the support post 12 in the first position (see FIG. 3F).

Figure 6A:
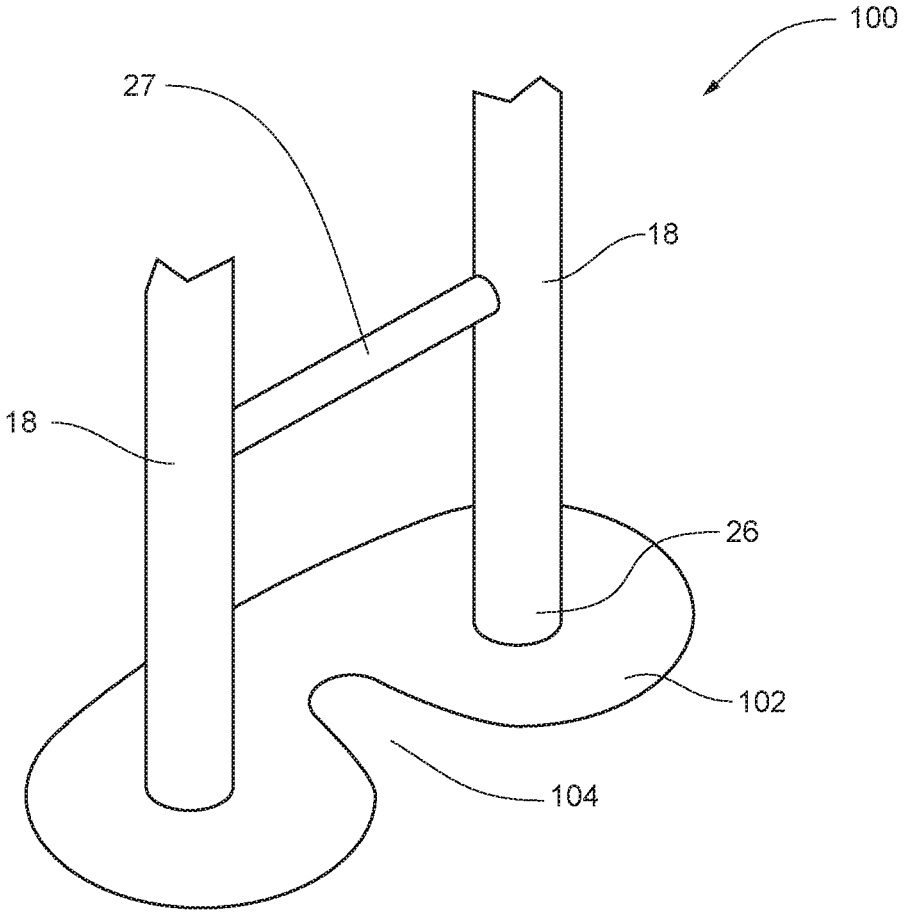
FIG. 6A is a pictorial perspective view of a lower portion of a dual-position seat attachment of an embodiment of the device.
Figure 6B:
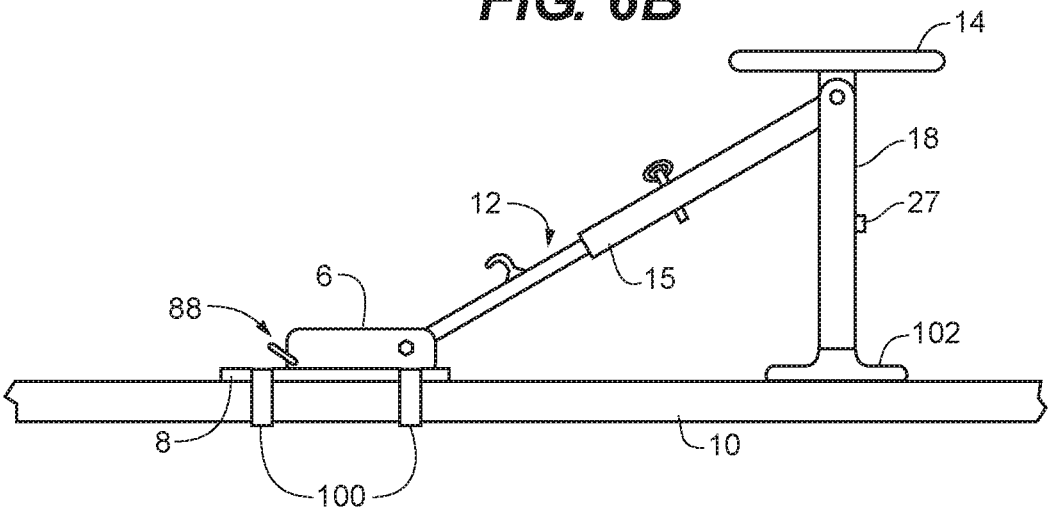
FIGS. 6B and 6C are side views of an embodiment of a device including the dual-position seat attachment of FIG. 6A in a seated position and stored position, respectively.
Figure 6C:
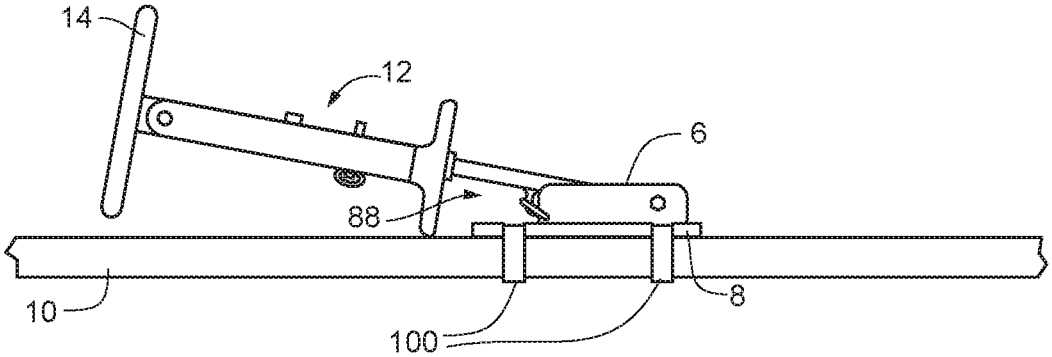

Referring also to FIG. 6A, in another embodiment 100, the seat attachment may further include a stabilizing base 102, of any appropriate shape, fixed to the bottom end 26 of each of the two legs 18, which may be cylindrically shaped. When the dual-position seat attachment is in the second position for use as a stool, as shown in FIG. 6B, the stabilizing base 102 is horizontally disposed adjacent the forward portion 7 of the base 8. To allow the seat attachment 100 to fold into alignment with the support post 12, for example, for storing (see also FIG. 6C), the stabilizing base 102 preferably includes a cut-away section 104 on the rear side in a shape that allows the support post 12 to be positioned between the legs 18 when the seat attachment 100 is aligned in the first position.

As shown in the figures, the user-support pad 14 may be used in a leaning, or sitting position, and may be of any suitable size or shape to provide support as a back rest in a sitting position, or leaning position, or as a stool with a seat attachment. The user-support pad may be rotatably connected to the upper end portion 3 of the support post 12 by any suitable means. Likewise, the lower end portion 11 of the support post 12 may be rotatably connected to the base 8 by any suitable means. While not intending to be limited thereto, by way of example, referring to FIGS. 4F-4H, in embodiments of a rotatably connected pad 14, a cylindrical connector 28, with connector 32 in place, may be fixedly mounted on assembly between attachment tabs 30 that extend from an underside of the pad 14 to provide an upper rotation axle for the user-support pad 14 to rotate around the upper horizontal rotation axis 34. The pad 14 is pivotedly connected to the support post 12, which in embodiments, includes telescoping portion 15, via the connector 28.

In embodiments, the upper rotation axle 28 is configured to frictionally engage with the connector 32, such that the pad 14 rotates with some resistance. In this way, once the user sets the desired rotational position of the pad 14, it will not freely rotate, but requires application of force by the paddler. In other embodiments, locking elements such as retaining pins, may be used to set a rotational position of the pad 14.

Referring to FIGS. 4A-4H, in one embodiment, the connector 32 is a hollow T-connector 32. The cylindrical connector 28 is inserted through a top 33 of the T 32 and so that when the connector 28 is fixedly mounted by pins or other means to the pad 14, e.g., in place between tabs 30 of the pad 14, the top 33 of the T 32 is also positioned between the tabs 30. Upon assembly, the pad 14 is thus configured to rotate around the fixed upper horizontal rotation axis 34 (around fixed rotation axle 28) of the top 33 of the hollow T-connector 32.

Figure 4A:
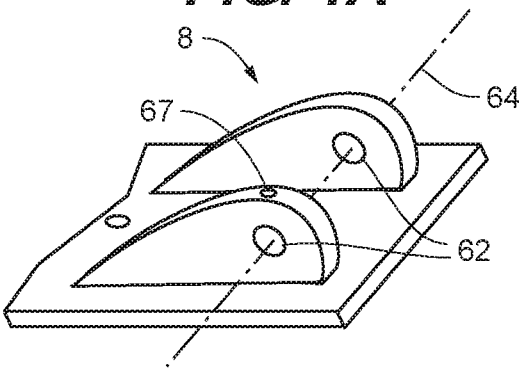
FIGS. 4A-4F are pictorial representations of components of an embodiment of the device of FIGS. 2A-2C.
Figure 4B:
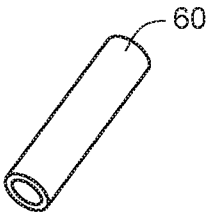
Figure 4C:
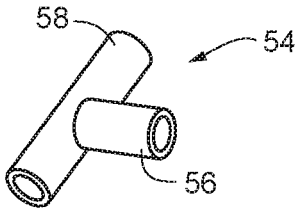
Figure 4D:
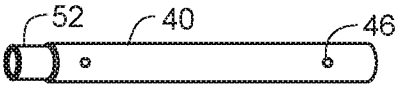
Figure 4E:
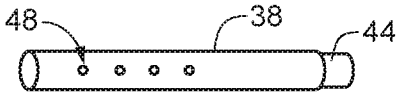
Figure 4F:
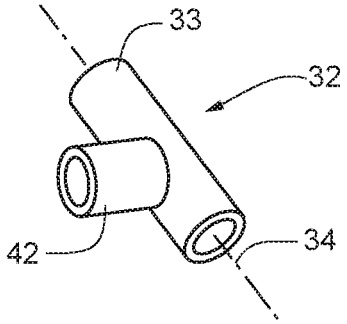
Figure 4G:
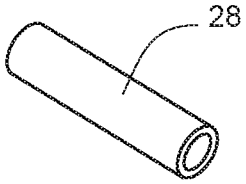
FIGS. 4G and 4H are pictorial representations of components of a pad portion of embodiments of the device of the present disclosure.
Figure 4H:
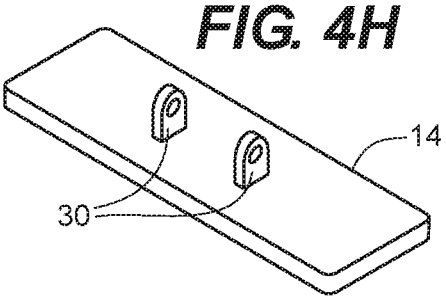

Referring to FIGS. 4D and 4E, the telescoping portion of the device 5, in embodiments, includes a top portion 38 for operably connecting to the pad 14 (e.g., via a connector such as the T-connector 32 and rod 28), and a bottom portion 40. The top 38 and bottom portion 40 are configured to cooperate in a telescoping fashion to allow adjustment of the length 36 of the support post 12 in use. In one embodiment, the top portion 38 connects to the pad 14 by insertion into a bottom leg 42 of the T-connector 32, as shown in FIGS. 4E and 4F. An upper end 44 of the top portion 38 may be sized for insertion into the T-connector 32 as shown.

The bottom portion 40 may, in embodiments, be inserted into the hollow end of the top portion 38 for telescopically adjusting the overall length 36 of the support post 12. Referring also to FIG. 2A, an alignment aperture 46 in the bottom portion 40 is then aligned to one of a plurality of receiving apertures 48 in the upper portion 38 and a suitable locking ring or pin 50 is inserted through both the alignment aperture 46 and a selected receiving aperture 48 for fixing the length 36 of the telescoping portion 15.

As shown, for example, in FIGS. 2A, 2B and FIGS. 4A-4D, the lower portion 11 of the support post 12, which may include telescoping portion 15, may be operatively and rotatably mounted to the horizontal rotation axle 60 in the base 8 via the mounting assembly 13. In embodiments, mounting assembly 13 includes a hollow base T-connector 54 and a cylindrical rod as the horizontal rotation axle 60, which may be fixed in place to the base 8 upon assembly by any suitable means, for example, using a screw or locking pin 66 mounted through an aperture 67 on the base 8, and fixed via a receiving aperture (which may be threaded) in the rod 60. A bottom end 52 of bottom portion 40 may be configured for insertion into a bottom leg 56 of the T-connector 54.

Figure 4I:
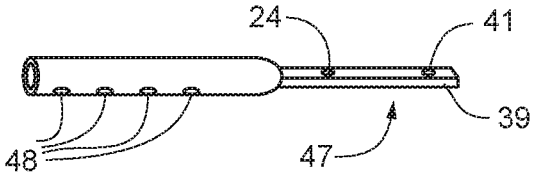
FIGS. 4I and 4J are pictorial representations of embodiments of components of the device shown in FIGS. 3A-3B.
Figure 4J:
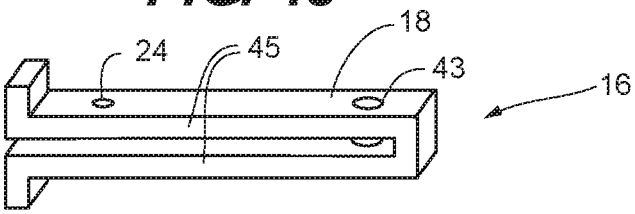
Figure 4K:
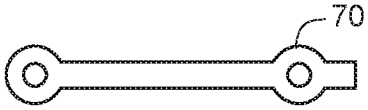
FIGS. 4K and 4L are pictorial representations of embodiments of a spring component of the device of the present disclosure.
Figure 4L:
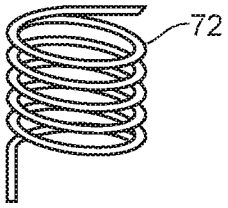
Figure 4M:
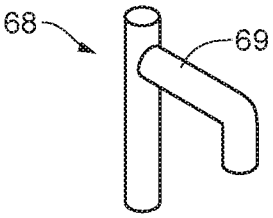
FIG. 4M is a perspective pictorial representation of an embodiment of a retaining element for retaining the user-support device in the stowed position.

Referring also to FIGS. 4I and 4J, embodiments of the device 5 that also include a seating attachment (see FIGS. 3A-3F, 6A-6C), may also include a telescoping portion 15 to allow adjustment of the length 36, having bottom portion 40 (see FIG. 4D) for rotatably mounting to the base 8, and for cooperating in a telescoping fashion with a top portion 39 (see FIG. 4I), which is configured to rotatably mount the seat pad 14 thereto. For example, top portion 39 may include an aperture 41 through its top end, which may be aligned with aperture 43 in seating attachment 16 (FIG. 4J) for insertion of cylindrical rod 28 therethrough. The cylindrical rod 28 is then locked in between the tabs 30 of the pad 14. Accordingly, in the embodiments that include a seating attachment, instead of the rod 28 being inserted into the T-connector 32 to operatively attach the pad 14 to the telescoping portion 15, the rod 28 is inserted through apertures 41 and 43 to hingedly mount the seating attachment 16 to the telescoping portion 15.

It should be noted that the telescoping portion 15 may have cylindrical outer and inner diameters or appropriate dimensions, as shown in FIGS. 4D, 4E and the section of FIG. 4I that includes receiving apertures 48, or may have rectangular or other suitably shaped cross-sections of suitable dimensions to allow the telescoping of one (top/bottom) portion inside the other. When including a seating attachment 16, 17 which may include planar surfaces 45 (FIGS. 4J, 3A-3E), in embodiments, at least an upper portion 47 of the top 39 of the telescoping portion 15 is preferably rectangularly shaped to provide a smaller footprint in the folded configuration of FIG. 3A, for example.

In other embodiments of the device including a dual-position seat attachment, for example, as shown in FIG. 3F, the entire telescoping portion 15 is cylindrical.

To rotatably mount the support post 12 to the base 8, the horizontal rotation axle 60 around which the support post 12 rotates is preferably fixed to the base 8 between the forward portion 7 and the rear portion 9. In the embodiment of FIGS. 4A-4H, a top 58 of the T-connector 54 is aligned with two opposing apertures 62, one in each of the two raised side support rails 6 on the base 8, and the horizontal rotation axle 60, which may be a cylindrical rod or pin, is inserted through the top 58 of the T-connector 54 and locked in position between the two opposing apertures 62. The inner diameter of the top 58 of the T-connector 54 and outer diameter of the pin 60 are sized so that the support post 12, along with the T-connector 54 to which the device is mounted, can freely rotate about the horizontal rotation axis 64 defined by the two opposing apertures 62 and pin 60.

Figure 5A:
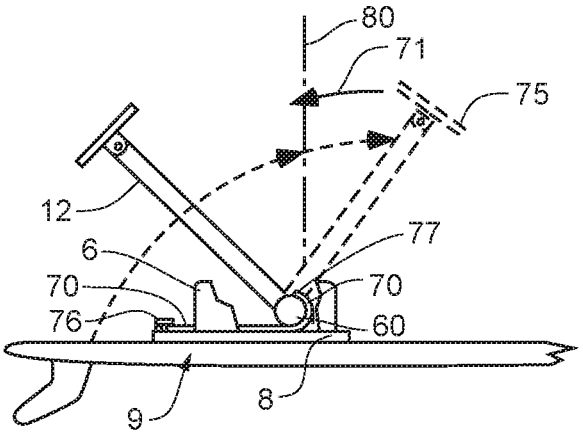
FIG. 5A is a pictorial representation of a side view of an embodiment of the device of the present disclosure configured with the spring component of FIG. 4K (shown with a cut-out in side rail 6 for viewing the spring attachment).
Figure 5B:
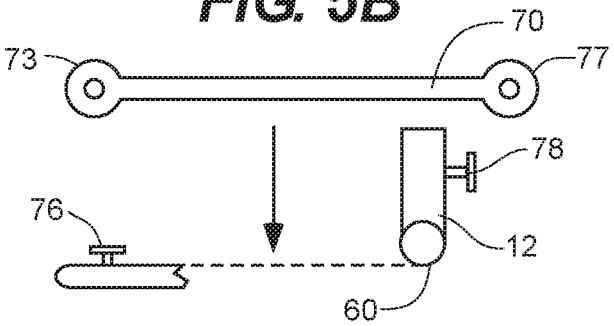
FIG. 5B is a pictorial representation of the spring component of FIG. 4K and attachment points prior to assembly with the embodiment of FIG. 5A.
Figure 5C:
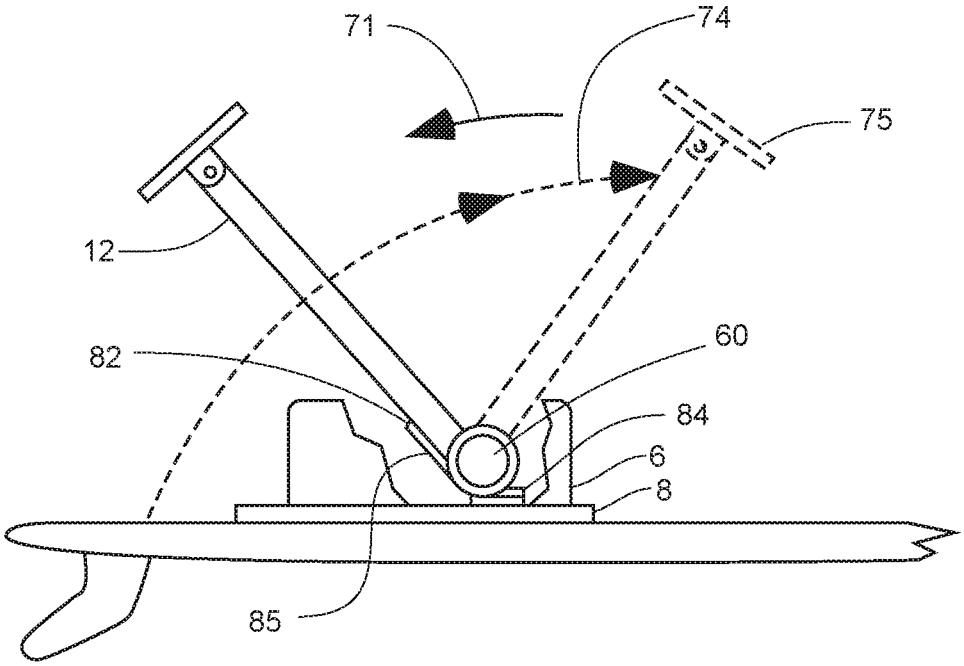
FIG. 5C is a pictorial representation of a side view of an embodiment of the device of the present disclosure configured with the spring component of FIG. 4L (shown with a cut-out in side rail 6 for viewing the spring attachment).

Referring to FIGS. 4K, 4L, and FIGS. 5A-5D, the device 5 also preferably includes a spring component, such as an elasticized band or strap 70 or coiled spring 72, preferably a torsional spring. In embodiments, the spring component may include a combination of both a coiled spring 72 and elasticized band 70. Referring, for example, to FIG. 5A and FIG. 5C, the spring component is appropriately fixed to the base 8 and returnably connected to the support post 12 to resist rotation of the support post 12 via the horizontal rotation axle 60 in a rearward direction 71 over the rear portion 9 of the base 8. The spring component thus imposes a load, or return force, on the support post 12 as it is rotated in the rearward direction 71 (toward the rear portion 9 of the base 8). Accordingly, when the support post 12 is fully rotated into the stored position (see FIGS. 1A, 1D, e.g.), it is fully loaded, e.g., spring-loaded with a return force.

Preferably, embodiments of the device 5 also include a retaining element, which can be any suitable latch, fixed to the base 8 and configured to hold the post 12 down in position over the rear of the SUP 14 in the stored position. For example, in embodiments, the retaining element may be a simple sliding or pivotedly positioned latch that can be easily positioned over the support post 12 in the stored position. Referring to FIGS. 1D, 2A-C, and 4M, for example, the retaining element may be a latch 68 pivotedly fixed to the base 8, which includes a latching portion 69 that can be easily pivoted and positioned, using the end of a paddle, for example, over the support post 12 to retain it in the stored position (FIGS. 2A, 1D). When the paddler wishes to use the device 5, the paddler may use the paddle to pivot the latching portion 69 away from the support post 12, as shown in FIG. 2C, for example, unlatching and releasing the spring-loaded post 12 from its stored position.

Referring to FIGS. 5A and 5C, once the support post 12 is released from its stowed or stored position by releasing or unlatching the retaining element, the support post 12 automatically springs up and rotatably returns along a path 74 around the horizontal rotation axle 60 preferably to a forwardly rotated position, i.e., forward of vertical, so that it is well within the user's reach. In the forwardly rotated position, the support post 12 forms an angle of ninety degrees or less with the forward portion 7 of the base 8. In embodiments, the forwardly rotated position to which the support post 12 returns is a resting position 75 defined by a position in which the spring component is in a relaxed state, i.e., with no load or force imposed on, or by, the spring component.

To obtain the return functionality of the spring-loaded support post 12 of the disclosure, a first end portion 73 of a spring component, such as the elasticized band 70 of FIGS. 5A and 5B, may be fixed at a first position 76 on the rear portion 9 of the base 8 by any suitable means (peg, e.g.). A second end portion 77 is attached at a second position 78 on a forward side of the support post 12, the elasticized band 70 being stretched from the first position 76 on the base around a bottom of, and partially encircling, the horizontal rotation axle 60, to the second position 78 on the forward side (adjacent the forward portion 7 of the base 8) of the support post 12. Rotation of the support post 12 in the rearward direction 71 over the rear portion 9 of the base 8, lengthens the distance traversed by the elasticized band 70 between the first position 76 and the second position 78 and thus stretches the band 70 and loads the support post 12 with a return force.

Preferably, the relaxed state of the band 70 is not reached until the pad 14 on the end of the telescoping portion 15 is positioned well forward of vertical 80. Preferably, the strap 70 is not fully relaxed before the pad 14 is in the forward back-rest position shown in FIG. 1C.

Multiple pegs at multiple positions 78 may be provided at different heights along the forward side of the support post 12 so that the load or return force on the support post 12 can be increased or decreased as desired.

Figure 5D:
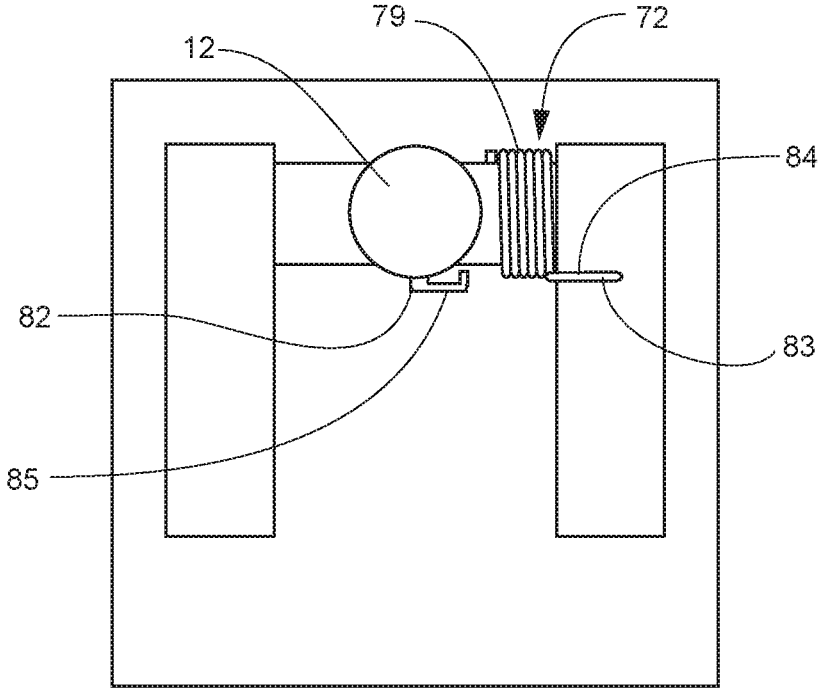
FIG. 5D is a pictorial representation of a top view of the device of FIG. 5C.

Referring to FIGS. 5C and 5D, in another embodiment, the spring element may include a torsion spring 72, with a first end portion 83 fixed by any suitable means to a first position 84 on the forward portion 7 of base 68, and a second end portion 85 is returnably connected at a second position 82 to a rear side of the support post 12, preferably with a coiled portion 79 between the first end portion 83 and the second end portion 85 encircling and wrapped around the horizontal rotation axle 60. The second end portion 85 is positioned such that rotation of the support post 12 in a rearward direction 71 over the rear portion 9 of the base 8 twistingly tightens the coiled portion 79 to impose a return force on the support post 12 when in a rearwardly rotated position over the rear portion of the base. When the support post 12 is in the resting position 75, the torsion spring 72 is in a relaxed state, with no load or return force imposed on the support post 12.

Accordingly, the spring component 72 is configured to maintain a return force on the support post 12 when it is rotated to the stored position (see FIG. 6C, e.g.) horizontally disposed over the rear portion 9 of the base 8 and over the rear of the stand-up paddle board 14, where it is held in place by a retaining element or latch 88, and to return the device to a forward position on the SUP 14 for easy access when unlatched and released from the stowed position.

Figure 7A:
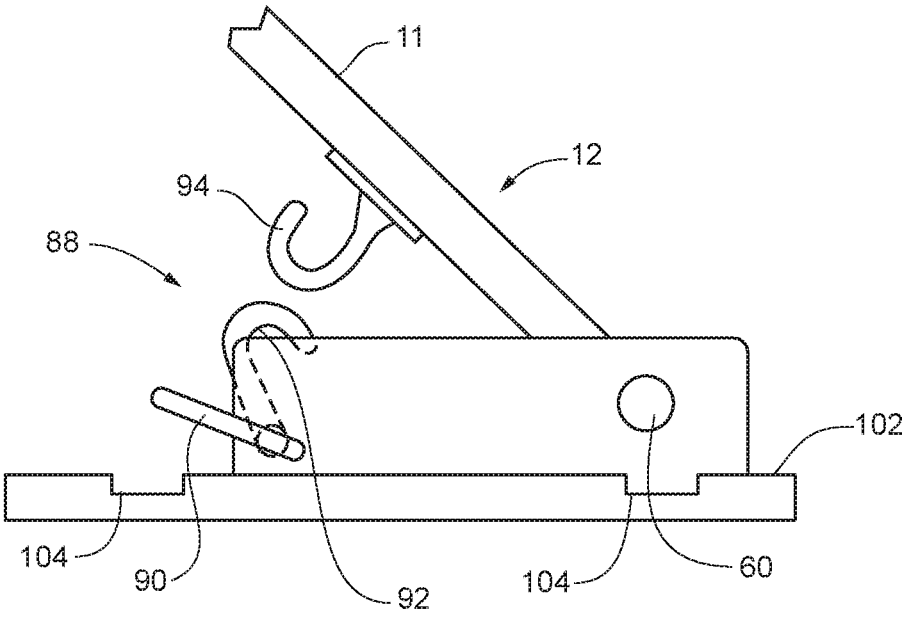
FIGS. 7A-7C are pictorial representations of a base of another embodiment of the user-support device, with a catch-and-release latch for retaining the support post in the stored position, and channels for mounting the base to a SUP.
Figure 7C:
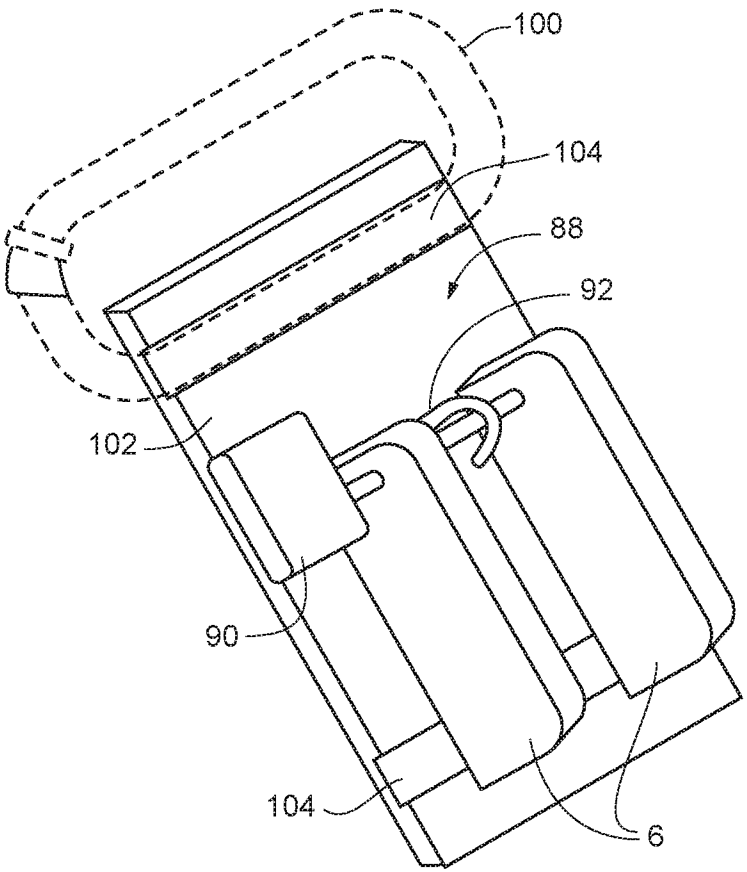
Figure 7B:
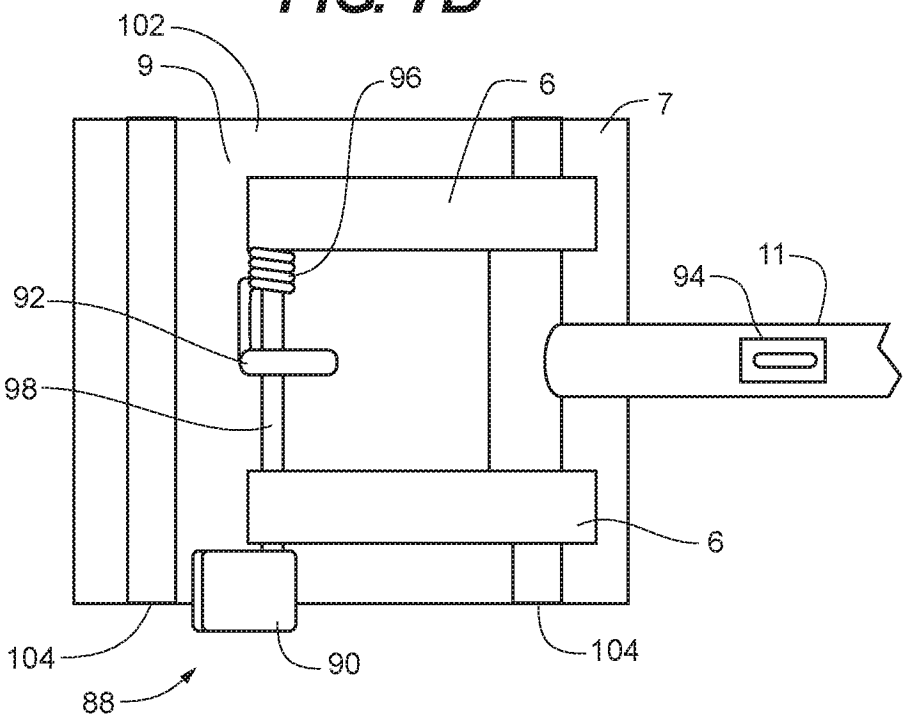

Referring also to FIGS. 7A-7C, in embodiments, the retaining element can include a spring-activated catch and release latch 88. In embodiments, the latch 88 includes an elbow catch 94 fixed to a rear of the lower end portion 11 of the support post 12, and a latching portion, such as a spring-activated elbow catch 92, operatively fixed to the rear portion 9 of the base 8. The spring-activated elbow catch 92 is positioned to frictionally engage the fixed elbow 94, and to automatically capture and retain the support post 12 in the stored position, by simply pushing the support post 12 down in a rearward direction onto the spring-activated elbow catch 92, until the catch 92 is pushed sufficiently downward to engage and capture the elbow catch 94 on the support post 12.

The spring-activated catch and release latch 88 also includes a release pedal or tab 90, operatively connected to the spring-activated elbow catch 92. To release the support post 12 from its stored, latched position, a paddler may push or step on the release tab 90, which pivots the spring-activated elbow catch 92 upward to disengage the fixed elbow 94.

Referring still to FIGS. 7A-7C, the spring-activated elbow catch 92, the spring portion 96 of the release mechanism, and the release pedal 90 are, in embodiments, connected to the base 8 via a dowel 98 pivotedly connected at its end portions to the two raised side support rails 6 on the base 8.

Referring still to FIGS. 7A-7C, in embodiments, the base 8 may be configured to be removably mounted via a brace and/or straps 100 or other less permanent means to the SUP. An upper surface 102 of the base 8 may include one or more strap-receiving recessed channels 104 traversing a width of the base 8. In embodiments, one of the channels is preferably located on the forward portion 7 and one on the rear portion 9 of the base 8. Any suitable strap 100 of any suitable cloth or elasticized material that can be wrapped around the SUP may be positioned within each channel 104 and tightened to hold the base 8 onto the board. Such straps 100 may include, but are not limited to, a strap tied together at its ends around the board, a belted strap, a ratcheted strap, and so on.

Additional embodiments of a user-support device 200, which is rotationally positional by the user as desired, including, but not limited to, any of the positions shown in FIGS. 1A-1C, is described and shown by reference to FIGS. 8-11C.

Figure 8:
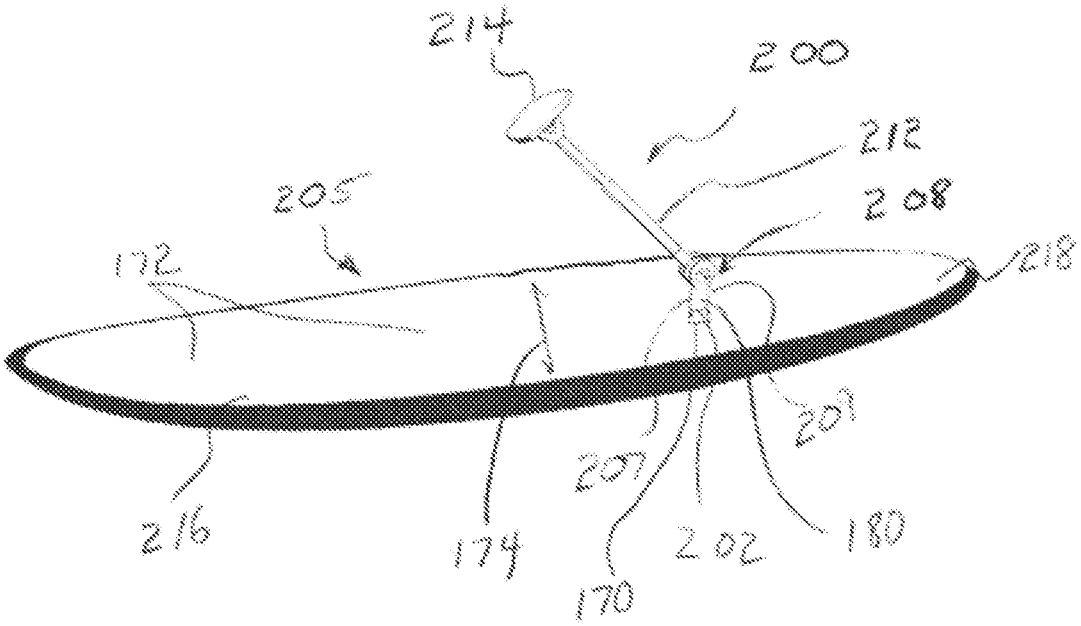
FIG. 8 is a pictorial representation of an embodiment of a stand-up paddle board ("SUP") with an embodiment of a user-support device of the disclosure mounted thereto.
Figure 9:
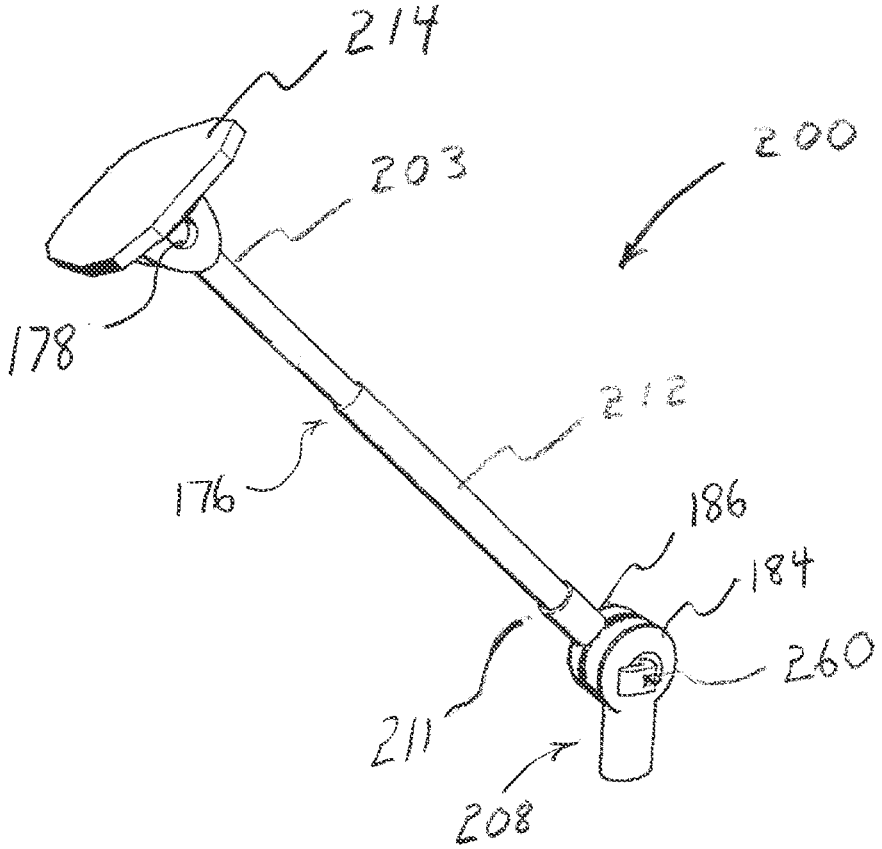
FIG. 9 is a pictorial representation of the embodiment of the user-support device of FIG. 8 before mounting to the SUP.

With reference to FIGS. 8 and 9, a stand-up paddle board 205 of the present disclosure may include a user-support device 200, which, in embodiments, is removably mounted to the SUP 205. FIGS. 8-11C also describe embodiments of a user-support device 200 for mounting to a SUP.

In embodiments, the device 200 for providing user-support on a stand-up paddle board 205 may include a mounting surface 202, which is configured to mount to the stand-up paddle board 205, and a rotatable support post 212 with user-support pad 214. The device 200 may also include a base 208, which may provide the mounting surface 202. The device 200, and in embodiments, the base 208, includes a forward portion 207, and a rear portion 209 aligned to a forward 216 and a rearward section 218, respectively, of the SUP 205 as described herein.

As shown in FIGS. 8 through 11C, the base 208 may include a stem 180 (FIGS. 10C, 10D, 11C, e.g.), which provides the mounting surface 202, and which may be inserted into a bore 170 (shown in dotted line as it would not be visible with the device 200 mounted therein) provided in an upper surface 172 of the SUP 205 for use. It should be noted that the device 200 may be mounted to any surface of the SUP 205, including but not limited to the upper surface 172 or a recessed surface provided in the board, including but not limited to, for example, the bore 170.

In embodiments, the device 200 is configured to be removably mounted to the SUP 205. In some embodiments, at least a lower portion of the device 200, e.g., the base 208, which may include the stem 180, may remain integral with the SUP 205, with at least the portion of the device 200 including the support post 212 being removable when not in use.

The SUP 205 and/or stem 180 may be provided with any suitable tab or locking element to stabilize the device 200 on the SUP 205 when mounted for use. In some embodiments, the stem 180 may be configured to tightly fit into a deep-enough bore to be secure for use. In other embodiments, the stem 180 may be inserted into and/or fixed, and in embodiments, integral with a planar surface, such as the mounting surface 2 of the base 8 shown in FIGS. 7A and 7C, which may then be affixed with any type of mounting hardware, or removably mounted via a brace and/or straps (see, e.g., straps 100, FIG. 7C) or other less permanent means to the SUP, as described supra.

Figure 11A:
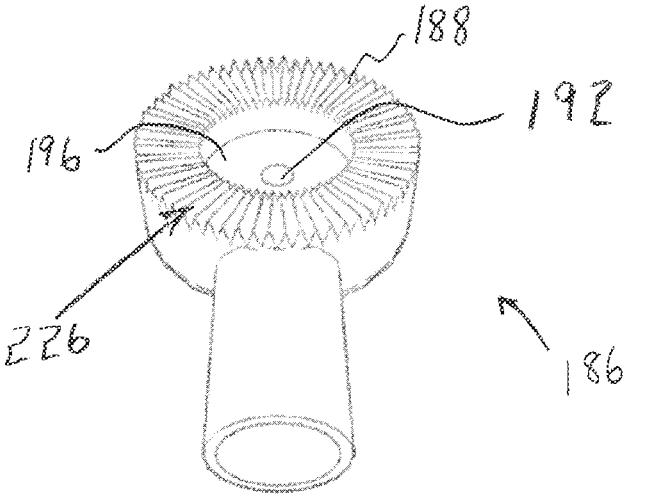
FIGS. 11A and 11B show two different views of a component of the lower portion of the device shown in FIGS. 10A-10D that includes a positioning arm.
Figure 11B:
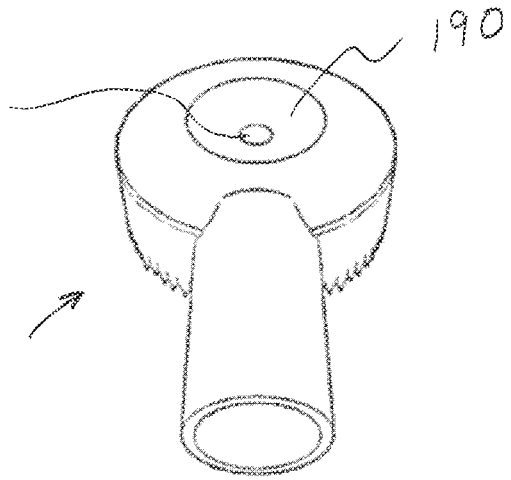
Figure 11C:
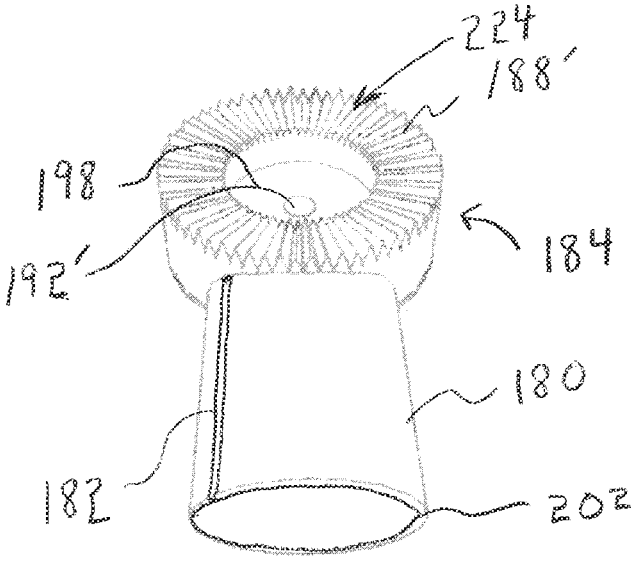
FIG. 11C is a pictorial view of a component of the lower portion of the device shown in FIGS. 10A-10D that includes a fixed arm.

Referring, for example, to FIG. 11C, in embodiments, the stem 180 is oval-shaped, or of other similar shape, the bore in the SUP having a complementary shape for positioning the stem 180 therein, to help the user orient the device 200 relative to the forward and rear sections of the SUP 205. In still additional embodiments, the stem 180 may include a ridge or other alignment element 182 along one outer surface, with the bore in the SUP 205 having a complementary recess appropriately positioned into which the ridge 182 or other element would align, to ensure that the stem 180 may only be inserted in one orientation for use.

Referring to FIGS. 10A-10D, the device 200 includes a horizontal rotation axle 260, which is operatively mounted to the stand-up paddle board 205, in embodiments, via the base 208 between the forward portion 207 and the rear portion 209. The device 200 is configured to be mounted to the SUP 205 with the horizontal rotation axle 260 positioned transversely 174 to a length (or normal direction of travel) of the SUP 205, so that the device 200 can rotate around the horizontal rotation axle 260 from a forward 216 to a rear 218 position of the SUP 205.

The support post 212 is rotatably connected, via a lower end portion 211, for example, to the horizontal rotation axle 260 for rotation around the horizontal rotation axle 260 so that the support post 212 is rotatable over the forward section 216 and over the rear section 218 of the SUP 205. The support post 212 is thus rotatable to any position for use, including to a vertical upright position, as selected by the paddler. Various positions are described herein supra. The device 200 and support post 212 can include any of the features of the embodiments of FIGS. 1A-3C, for example, including, but not limited to, a telescoping portion 176 and a pad rotation axle 178 for rotation of the user-support pad 214. The support post 212 is also rotatable to a stored position, as described herein, when a paddler chooses not to use the device 200, but does not wish to remove it. In embodiments, the stored position is over the rear section 218 of the SUP 205, and in further embodiments, rotated as far over the rear section 218 as possible, as shown in FIG. 1C, for example. However, the stored position, in embodiments, could optionally correspond to a forward rotated position over the forward section 216, e.g., rotated as far over the forward section 216 as possible.

The device also includes a spring component 270 returnably connected to the support post 212 via the horizontal rotation axle 260. The spring component 270 is positioned and configured to impose a return force on the support post 212 when it is in a stored position, for example, rearwardly rotated over the rear section 218 of the SUP 205. In embodiments, the spring component 270 at least partially encircles the horizontal rotation axle 260.

As shown, in embodiments, a first end portion 273 of the spring component 270 is configured to be operatively fixed to a position on the SUP 205. In embodiments, the first end portion 273 is fixed to a fixed arm 184, which is operatively mounted to the SUP 205, for example, via the base 208. Neither the fixed arm 184 nor the first end portion 273, in embodiments, rotate with the rotation of the support post 212. A second end portion 277 is operatively connected to the support post 212 via a positioning arm 186, and is rotatable with the positioning arm 186 and support post 212 attached thereto. The spring component 270 may be a torsional spring, configured such that a return force is imposed when the device 200 is rotated to a stored position, which in embodiments is a rearward position over the rear section 218 of the SUP 205.

As can be seen in FIGS. 10C, 10D, 11A and 11C, each of the positioning arm 186 and the fixed arm 184 have locking grooves 188 and 188'. To lock the support post 212 into any desired position, the positioning arm 186 and the fixed arm 184 are forced together using a locking element 274, described below, such that the locking grooves 188 and complementary locking grooves 188', positioned on interior facing surfaces 166, 164 of the positioning arm 186 and the fixed arm 184, respectively, interlock to hold the desired position. Each of the first 273 and second end portion 277 of the spring component 270 may, for example, be fixed simply by wedging each into one of the grooves 188' and 188, respectively. In other embodiments, each of the ends may be fixed by other suitable means including, but not limited to, epoxy, or by threading through a hole provided through, for example, the raised edges forming one of the grooves.

As in other embodiments, in the forwardly rotated position, in which the support post 212 forms an angle of ninety degrees or less with the forward section 216 of the SUP 205, the spring component 270 is in a relaxed state, i.e., with no load or force imposed on the support post 212 by the spring component 270. It will be appreciated that when assembling the end portions 273, 277 of the spring component, the spring component should be in the relaxed state with the support post 212 oriented to form an angle of ninety degrees or less with the forward section 216 of the SUP 205.

The stowed or stored position of the device 200 shown in FIGS. 8 and 9 does not require a separate latching device on the board SUP 205 to keep it from springing up. Instead, referring to FIGS. 10A-10G, the device 200 includes a latching or locking device 274 that locks the support post 212 into any position, which is set by the paddler, between a forwardly rotated position with the support post 212 at least parallel or substantially parallel over the front 216 of the SUP 205 and a rearwardly rotated position with the support post 212 at least parallel or substantially parallel over the rear 218 of the SUP 205, including in the stored position in which the spring 270 will be loaded. To rotate the support post 212, the paddler simply unlocks the locking device 274, for example, by flipping a tab 160 (see FIG. 10B; tab 160 shown in a down, locked position) on the locking device 274 into an open position. This disengages the locking grooves 188, 188' and allows rotation of the support post 212. The spring component 270 will load, for example, by tightening of the coils 168, as the support post 212 is forced toward a stored position, e.g., a rearward stored position. When rotated to a stored position, sufficiently out of the paddler's way, the paddler presses down on the tab 160 on the locking device 274 to engage the locking grooves 188, 188' and fix the position of the support post 212, with the spring component 270 in a loaded state. When the support post 212 is in this storage position, which in embodiments is a rearward position, and the tab 160 on the locking device 274 is flipped open, the spring uncoils or relaxes, springing the support post 212 back to an upright (vertical) or forwardly rotated position, so that it is well within the user's reach.

Referring to FIGS. 10C-10G, in embodiments, the horizontal rotation axle 260 may be in the form of a rod having a first end portion 262, which may be a circular tab or head, configured to mount flush against an outer surface 190 of the positioning arm 186 upon assembly of the rod (horizontal rotation axle) 260 through co-aligned apertures 192, 192' in both the positioning arm 186 and the fixed arm 184. The locking device 274 may, in embodiments, be connected via a notch 275, or any other connecting element, to a second end portion 264 of the horizontal rotation axle 260, which extends through the outer surface 194 of the fixed arm 184 for assembly with the locking device 274. The locking grooves 188 and 188' of each of the positioning arm 186 and the fixed arm 184, respectively, are configured to align, interlock, and thus lock the support post 212 into any desired rotational position by forcibly pushing the locking mechanism 274 down into a locked position for use, or for storage.

Figure 10A:
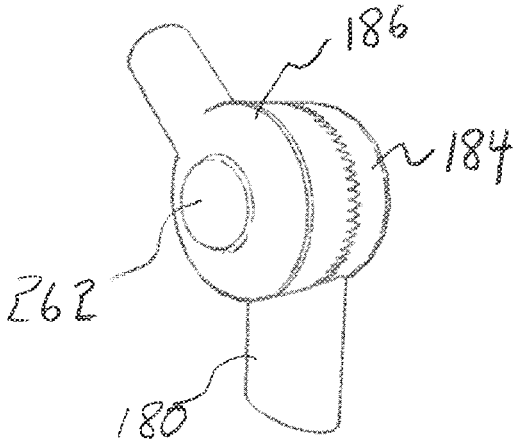
FIGS. 10A and 10B are pictorial representations of a lower portion of the user-support device of FIG. 9 without the support post attached, from a front and back view.
Figure 10B:
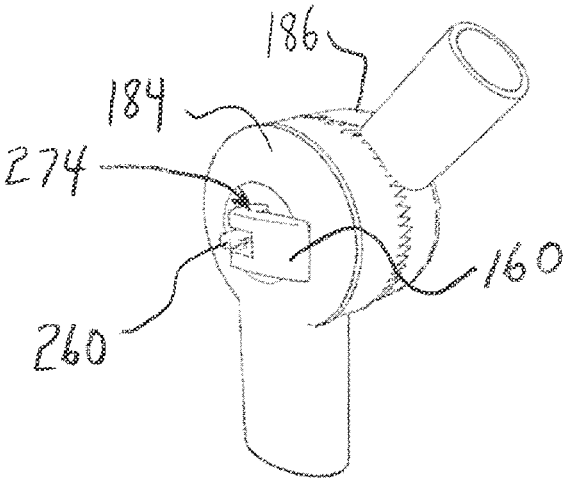
Figure 10C:
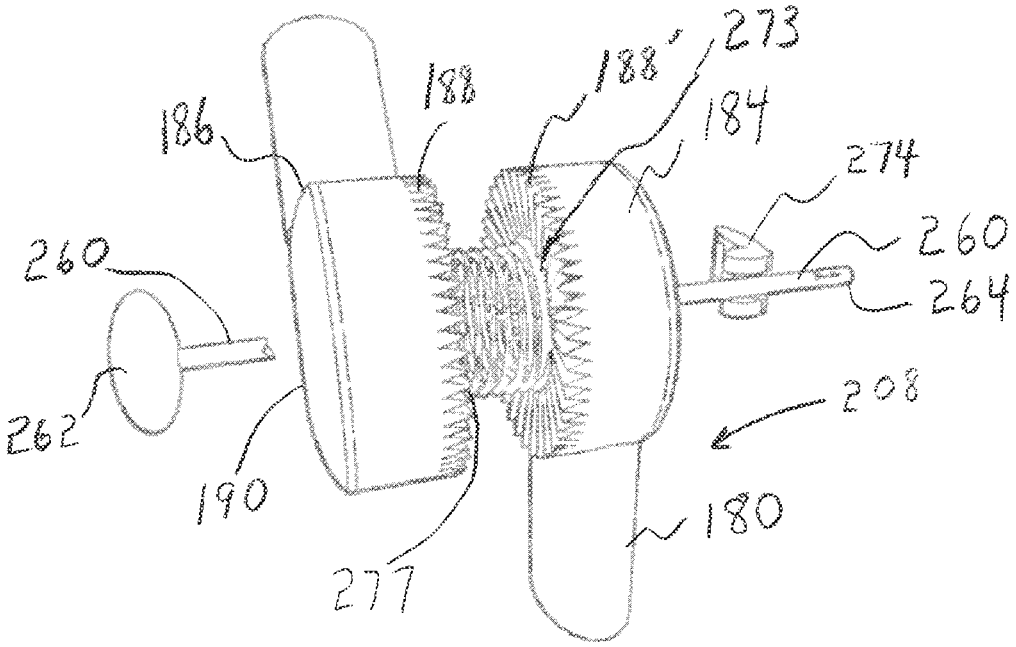
FIGS. 10C and 10D are exploded views of FIGS. 10A and 10B, respectively.
Figure 10D:
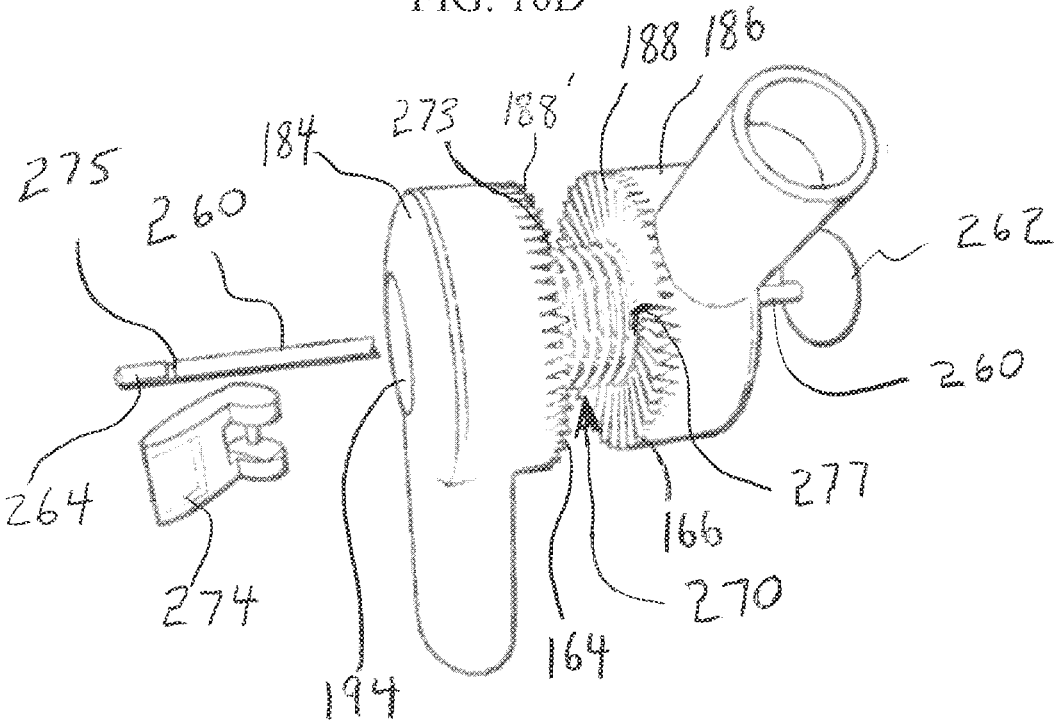
Figure 10E:
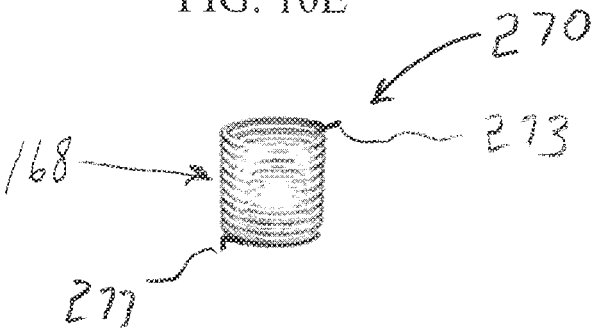
FIGS. 10E-10G are elements of the embodiment of the device of FIG. 8.
Figure 10F:
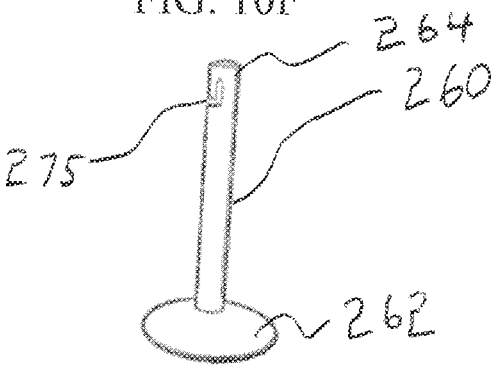
Figure 10G:
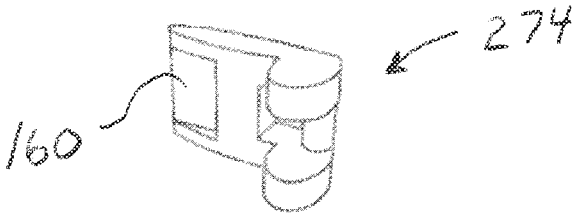

Referring also to FIGS. 10C and 10D, when the horizontal rotation axle 260 is assembled through the positioning arm 186 and the fixed arm 184 and in co-alignment therewith, it is preferably also inserted between the coils 168 (see FIG. 10E) of the spring component 170, such that the spring component 170 encircles the horizontal rotation axle 260. When the desired rotational position of the support post 212 is locked down by the paddler via the locking element 274, the spring component 170 is sandwiched between the fixed arm 184 and the positioning arm 186. To allow assembly of the spring component 170, referring to FIGS. 11A-11C, the body of each of the fixed arm 184 and the positioning arm 186 may have recessed portions 198 and 196, respectively, in inner facing portions 224, 226, respectively, which form an inner space into which the spring component 270 is positioned upon assembly.

Like other embodiments described herein, the spring 270 is positioned and configured such that rotation of the support post 212 toward the stored position, e.g., in a rearward direction over the rear section 218 of the SUP 205, twistingly tightens the coiled portion 168 of the spring 270 to impose a return force on the support post 212 when in the stored position. In addition, in the embodiments of FIGS. 8-11C, the rotational position of the support post 212 and user-support pad 214 may be set, and locked in, at a number of incremental rotational positions determined by the number of pairs of interlocking grooves 188, 188', i.e., by the angular separation imposed by a spacing of the grooves 188, 188'. The support post 212 is thus locked in a stored position, with the spring 270 loaded with a return force, by the same locking element 274 that locks in any of the other rotational positions at which the paddler may wish to position the user-support pad 214.

Additional embodiments of the device 200 shown and described in reference to FIGS. 8-11C may include any of the additional features described herein. For example, the device 200 may also include the seat attachment 16 shown in FIGS. 3A-3F, which may be a dual-position seat attachment, like that shown in FIGS. 3A-3C or like seat attachment 17 shown in FIGS. 3D-3F as another example.

It should also be appreciated that a stand-up paddle board, e.g., SUP 205, including any of the embodiments of the device 200 or any other embodiments of the user-support device 5 of the present disclosure, which may be removably mounted to the SUP 205, is also within the scope of the present disclosure.

With reference to FIGS. 8 and 9, for example, a stand-up paddle board 205 of the present disclosure may include a user-support device 200, which, in embodiments, is removably mounted to the SUP 205. The user-support device 200 includes the support post 212 with the user-support pad 214 mounted to its upper end portion 203, and also includes the horizontal rotation axle 260. The device is mounted to the stand-up paddle board 205 so that the horizontal rotation axle 260 is positioned transversely 174 to a length of the SUP 205, for rotation around the horizontal rotation axle 260 to a position for use anywhere from the forward 216 to rear section 218 of the SUP 205, and to a stored position. The device 200, which may be removably mounted to the SUP 205, also includes the spring component 270 (see also FIGS. 10C and 10D) returnably connected to the support post 212 via the horizontal rotation axle 260, the spring component 270 being positioned and configured to impose a return force on the support post 212 when in a stored position, for example, rotated over the rear section 218 of the stand-up paddle board.

The various components of embodiments of the device of the present disclosure may be formed from any one or more of a number of, but not limited to, suitable metals or metal alloys, aluminum, carbon fiber, steel, plastics, fiberglass, and rubbers. As described, the device may further be configured with interchangeable locking parts as well as easily adjustable components, using a system of locking pins or rings. The device is configured to provide a small footprint on a SUP, especially when not in use, and to require minimum balance shifting of the user when stowing or releasing the device for use, and while adjusting the device to a comfortable leaning or sitting position while on the water.

Unlike any other known seat accessories for a SUP, the multi-position user-support device of the present disclosure provides an easy-to-adjust, use, and stow design requiring simple release with one's paddle to begin using on the water. Once released for use, locking pins may be utilized to lock in a desired length at any angular position selected by the user. The device is thus configured to avoid any weight shifting, leaning, and so on that might cause the paddler to lose his or her balance whether activating, using, adjusting, or stowing the device.

While particular embodiments of the disclosed device have been particularly shown and described with reference to specific embodiments, it should be apparent to those skilled in the art that the foregoing is illustrative only and not limiting, having been presented by way of example only. It is to be understood that the disclosed embodiments are merely examples of the disclosure, which may be embodied in various forms and detail without departing from the spirit and scope of the disclosure. Therefore, specific structural and functional details disclosed herein are not to be interpreted as limiting. Numerous other embodiments are contemplated that fall within the scope of the accompanying claims and equivalents thereto.

What is claimed is:

1. A device for providing user-support on a stand-up paddle board, the device comprising:

a support post, the support post including a user-support pad mounted to an upper end portion of the support post;

a horizontal rotation axle, the support post rotatably connected to the horizontal rotation axle for rotation to a position for use, and to a stored position, the device configured to be mounted to the stand-up paddle board with the horizontal rotation axle positioned transversely to a length of the stand-up paddle board; and a spring component, the spring component returnably connected to the support post via the horizontal rotation axle and configured to impose a return force on the support post in the stored position.

2. The device of claim 1, the device further comprising a fixed arm operatively mounted to the stand-up paddle board and a positioning arm operatively connected to the support post, wherein the positioning arm is co-aligned with and rotationally positionable to the fixed arm via the horizontal rotation axis.

3. The device of claim 2, wherein the spring component at least partially encircles the horizontal rotation axle, the spring component including a first end portion fixed to the fixed arm and a second end portion fixed to the positioning arm such that rotation of the positioning arm toward the stored position twistingly tightens the spring component to impose the return force on the support post.

4. The device of claim 2, wherein the positioning arm includes locking grooves and the fixed arm includes complementary locking grooves configured to interlock with the locking grooves, the locking grooves and the complementary locking grooves positioned on interior facing surfaces of the positioning arm and the fixed arm, respectively, for locking the support post in the position to a locked rotational position for use.

5. The device of claim 4, wherein the spring component is sandwiched between the positioning arm and the fixed arm in the locked rotational position for use.

6. The device of claim 5, further comprising a locking element configured to force the positioning arm and the fixed arm together for locking the position to the locked rotational position and to separate the positioning arm and the fixed arm for unlocking and rotating the support post.

7. The device of claim 6, further including a fixed tab attached to a first end portion of the horizontal rotation axle, the fixed tab positioned on an outer surface of the positioning arm, the horizontal rotation axle including a second end portion extending through an outer surface of the fixed arm, wherein the locking element is connected to the second end portion and includes a locking tab having a downward position, the locking tab in the downward position cooperating with the fixed tab to force the fixed arm and the positioning arm together in the locked rotational position, the locking tab including an upward position and cooperating with the fixed tab in the upward position to separate and disengage the fixed arm and the positioning arm for rotating the support post.

8. The device of claim 6, wherein the locking element is configured to lock the support post in the stored position with the return force on the support post, the spring component being tighteningly twisted in the stored position, the support post further configured to spring upward from the stored position with the unlocking of the locking element to separate the positioning arm and the fixed arm.

9. The device of claim 1, further comprising a base configured to removably mount the device to the stand-up paddle board.

10. The device of claim 1, further comprising a dual-position seat attachment.

11. A stand-up paddle board, the stand-up paddle board comprising:

a device for providing user-support on a stand-up paddle board, the device including:

a support post, the support post including a user-support pad mounted to an upper end portion of the support post;

a horizontal rotation axle, the support post rotatably connected to the horizontal rotation axle for rotation to a position for use, and to a stored position, the device mounted to the stand-up paddle board with the horizontal rotation axle positioned transversely to a length of the stand-up paddle board; and a spring component, the spring component returnably connected to the support post via the horizontal rotation axle and configured to impose a return force on the support post in the stored position.

12. The stand-up paddle board of claim 11, wherein the device includes a base, the device removably mounted to the stand-up paddle board via the base.

13. The stand-up paddle board of claim 12, including a recessed surface to which at least a portion of the base is mounted thereto.

14. The stand-up paddle board of claim 11, the device further comprising a fixed arm operatively mounted to the stand-up paddle board and a positioning arm operatively connected to the support post, wherein the positioning arm is co-aligned with and rotationally positionable to the fixed arm via the horizontal rotation axis.

15. The stand-up paddle board of claim 14, wherein the spring component at least partially encircles the horizontal rotation axle, the spring component including a first end portion fixed to the fixed arm and a second end portion fixed to the positioning arm such that rotation of the positioning arm toward the stored position twistingly tightens the spring component to impose the return force on the support post.

16. The stand-up paddle board of claim 14, wherein the positioning arm includes locking grooves and the fixed arm includes complementary locking grooves configured to interlock with the locking grooves, the locking grooves and the complementary locking grooves positioned on interior facing surfaces of the positioning arm and the fixed arm, respectively, for locking the support post in the position to a locked rotational position for use, and wherein the spring component is sandwiched between the positioning arm and the fixed arm in the locked rotational position for use.

17. The stand-up paddle board of claim 16, the device further comprising a locking element configured to force the positioning arm and the fixed arm together for locking the position to the locked rotational position and to separate the positioning arm and the fixed arm for unlocking and rotating the support post.

18. The stand-up paddle board of claim 17, the device further including a fixed tab attached to a first end portion of the horizontal rotation axle, the fixed tab positioned on an outer surface of the positioning arm, the horizontal rotation axle including a second end portion extending through an outer surface of the fixed arm, wherein the locking element is connected to the second end portion and includes a locking tab having a downward position, the locking tab in the downward position cooperating with the fixed tab to force the fixed arm and the positioning arm together in the locked rotational position, the locking tab including an upward position and cooperating with the fixed tab in the upward position to separate and disengage the fixed arm and the positioning arm for rotating the support post.

19. The stand-up paddle board of claim 17, wherein the locking element is configured to lock the support post in the stored position with the return force on the support post, the spring component being tighteningly twisted in the stored position, the support post further configured to spring upward from the stored position with the unlocking of the locking element to separate the positioning arm and the fixed arm.

20. The stand-up paddle board of claim 11, the device further comprising a dual-position seat attachment, wherein the dual-position seat attachment includes two legs positioned below the user-support pad and a connector, an upper end of each of the two legs hingedly coupled via the connector to an upper end portion of the support post, and a fixing element configured to fix a bottom end of each of the two legs to the support post in a first position, the two legs being fixed via the fixing element in-line with the support post in the first position, the fixing element further configured to release the two legs from the first position to rotate to a second position of the dual-position seat attachment, the dual-position seat attachment further comprising a stabilizing base fixed to the bottom end of each of the two legs.

* * * * *